US006655422B2

(12) United States Patent
Shock

(10) Patent No.: US 6,655,422 B2
(45) Date of Patent: Dec. 2, 2003

(54) COMPUTER CONTROLLED APPARATUS AND METHOD OF FILLING CYLINDERS WITH GAS

(75) Inventor: Robert F. Shock, Meriden, CT (US)

(73) Assignee: ATNL, Inc., Wilmington, DE (US)

( * ) Notice: Subject to any disclaimer, the term of this patent is extended or adjusted under 35 U.S.C. 154(b) by 0 days.

(21) Appl. No.: 10/223,051

(22) Filed: Aug. 16, 2002

(65) Prior Publication Data

US 2003/0070724 A1 Apr. 17, 2003

Related U.S. Application Data

(60) Provisional application No. 60/324,876, filed on Sep. 26, 2001.

(51) Int. Cl.[7] ..... B65B 31/00

(52) U.S. Cl. ..... 141/83; 141/1; 141/3; 141/4; 141/9; 141/18; 141/100; 141/104; 141/94; 141/128; 141/197

(58) Field of Search ..... 141/1–4, 9, 18, 141/21, 83, 100, 104, 105, 128, 192, 197

(56) References Cited

U.S. PATENT DOCUMENTS

| | | | | |
|---|---|---|---|---|
| 4,657,055 A | * | 4/1987 | Poulsen | 141/83 |
| 4,989,160 A | | 1/1991 | Garrett et al. | |
| 5,329,463 A | | 7/1994 | Sierk et al. | |
| 5,440,477 A | | 8/1995 | Rohrberg et al. | |
| 5,508,947 A | | 4/1996 | Sierk et al. | |
| 5,513,678 A | | 5/1996 | Schultz | |
| 5,657,254 A | | 8/1997 | Sierk et al. | |
| 5,826,632 A | | 10/1998 | Mické et al. | |
| 5,868,176 A | | 2/1999 | Barajas et al. | |
| 5,881,779 A | * | 3/1999 | Kountz et al. | 141/83 |
| 5,913,344 A | | 6/1999 | Wronski et al. | |
| 5,992,478 A | | 11/1999 | Micke et al. | |
| 6,135,170 A | | 10/2000 | Lee et al. | |
| 6,152,192 A | | 11/2000 | Klotz et al. | |
| 6,182,713 B1 | | 2/2001 | Deck et al. | |
| 6,591,872 B2 | * | 7/2003 | Wagenheim | 141/2 |
| 2003/0051766 A1 | * | 3/2003 | Nguyen | 141/18 |

* cited by examiner

*Primary Examiner*—J. Casimer Jacyna
(74) *Attorney, Agent, or Firm*—RatnerPrestia

(57) ABSTRACT

A method of filling a cylinder with a target weight of a gas. The method includes successively measuring weight of the cylinder at periodic time intervals to obtain successive actual weights of the cylinder; opening a first valve and filling the cylinder with the gas at a high flow rate; and closing the first valve after reaching a predetermined weight difference between the target weight and an actual weight. After closing the first valve, the method opens a second valve and fills the cylinder with the gas at a low flow rate. After opening the second valve to fill the cylinder with the gas, the method adjustably controls, via an adjustable valve, the flow of gas to the cylinder. The method differences each successively measured actual weight from the target weight of the gas to obtain multiple first difference values. The method also differences adjacently measured actual weights to obtain multiple second difference values. The flow of gas to the cylinder is adjustably controlled based on each first difference value and a corresponding second difference value.

20 Claims, 33 Drawing Sheets

300

400

COMPUTER CONTROLLED APPARATUS AND METHOD OF FILLING CYLINDERS WITH GAS

This application claims priority of U.S. Provisional Patent Application Serial No. 60/324,876 filed Sep. 26, 2001.

FIELD OF THE INVENTION

The present invention relates, in general, to a computer controlled method of filling cylinders with gas and, more specifically, to a computer controlled method of filling cylinders with specialty gases requiring precise tolerance in obtaining desired gas mixture ratios.

BACKGROUND OF THE INVENTION

For many years, the process of filling cylinders with gases or gas mixtures was performed manually. The gas distributor would have large storage cylinders filled with liquefied gases, such as oxygen, nitrogen, argon, carbon dioxide and helium. Via a manifold, he would simultaneously fill ten, twenty or more cylinders. As a first step, the cylinders were vented, meaning that whatever gas was in the cylinders was bled off. Usually a vacuum pumping system was connected to the manifold to draw a vacuum to evacuate the cylinders. Often one or more purges were performed, meaning, using a different pumping system, the cylinders would be filled with some of the compressed gas, which was then vented. Then, the cylinders were again evacuated. This purging cycle could be repeated as many times as was necessary with whichever gas was necessary to achieve the desired purity of the cylinders. Finally, the cylinders were filled with the specified gas or gas mixture to a predetermined pressure at a stated temperature.

In the process of making gas mixtures, two predominant methods existed. One method was to fill the cylinders with each gas to a different partial pressure to obtain the desired gas mixture ratios. The other method was to weigh in different amounts of various gases to obtain the desired gas ratios. In performing these various steps, the operator would monitor the temperature of the cylinders and the pressures in the system and, in some cases, a scale representing the weight of the gas in the cylinders. For example, when the cylinders were vented, the operator would monitor the pressure in the cylinders and when it reached a predetermined level, he would know it was time to start the evacuation process. Again, he would monitor the pressure to determine when the next step would be taken. The entire process was very time consuming and resulted in much lost time for the operator and the equipment.

It has been recognized that computer control of the filling process would substantially reduce the time it would take to vent, evacuate and fill cylinders, and thereby increase the number of cylinders that an operator could fill during a given time period. There are computerized systems in the marketplace. They are usually made for a particular system to fill cylinders with a particular gas or gas mixture and are not suited for high tolerance mixtures.

SUMMARY OF THE INVENTION

To meet this and other needs, and in view of its purposes, the present invention provides a method of filling a cylinder with a target weight of a gas. The method uses a computer controlled system that includes (a) a source of gas, (b) a plurality of valves for controlling flow of the gas to the cylinder, (c) a transducer for measuring pressure of the gas flowing to the cylinder, and (d) a weight scale for determining weight of the cylinder when filling the cylinder with the gas. The method of filling the cylinder with a target weight of the gas includes successively measuring the weight of the cylinder at periodic time intervals to obtain successive actual weights of the cylinder; opening a first valve and filling the cylinder with the gas at a high flow rate; and closing the first valve after reaching a predetermined weight difference between the target weight and an actual weight. After closing the first valve, the method opens a second valve and fills the cylinder with the gas at a low flow rate. After opening the second valve to fill the cylinder with the gas, the method also adjustably controls, via an adjustable valve, the flow of gas to the cylinder. The method differences each successively measured actual weight from the target weight of the gas to obtain multiple first difference values. The method also differences adjacently measured actual weights to obtain multiple second difference values. The flow of gas to the cylinder is adjustably controlled based on each first difference value and a corresponding second difference value.

It is understood that the foregoing general description and the following detailed description are exemplary, but are not restrictive, of the invention.

BRIEF DESCRIPTION OF THE DRAWING

The invention is best understood from the following detailed description when read in connection with the accompanying drawing. Included in the drawing are the following figures.

DETAILED DESCRIPTION OF THE INVENTION

Figure 1:
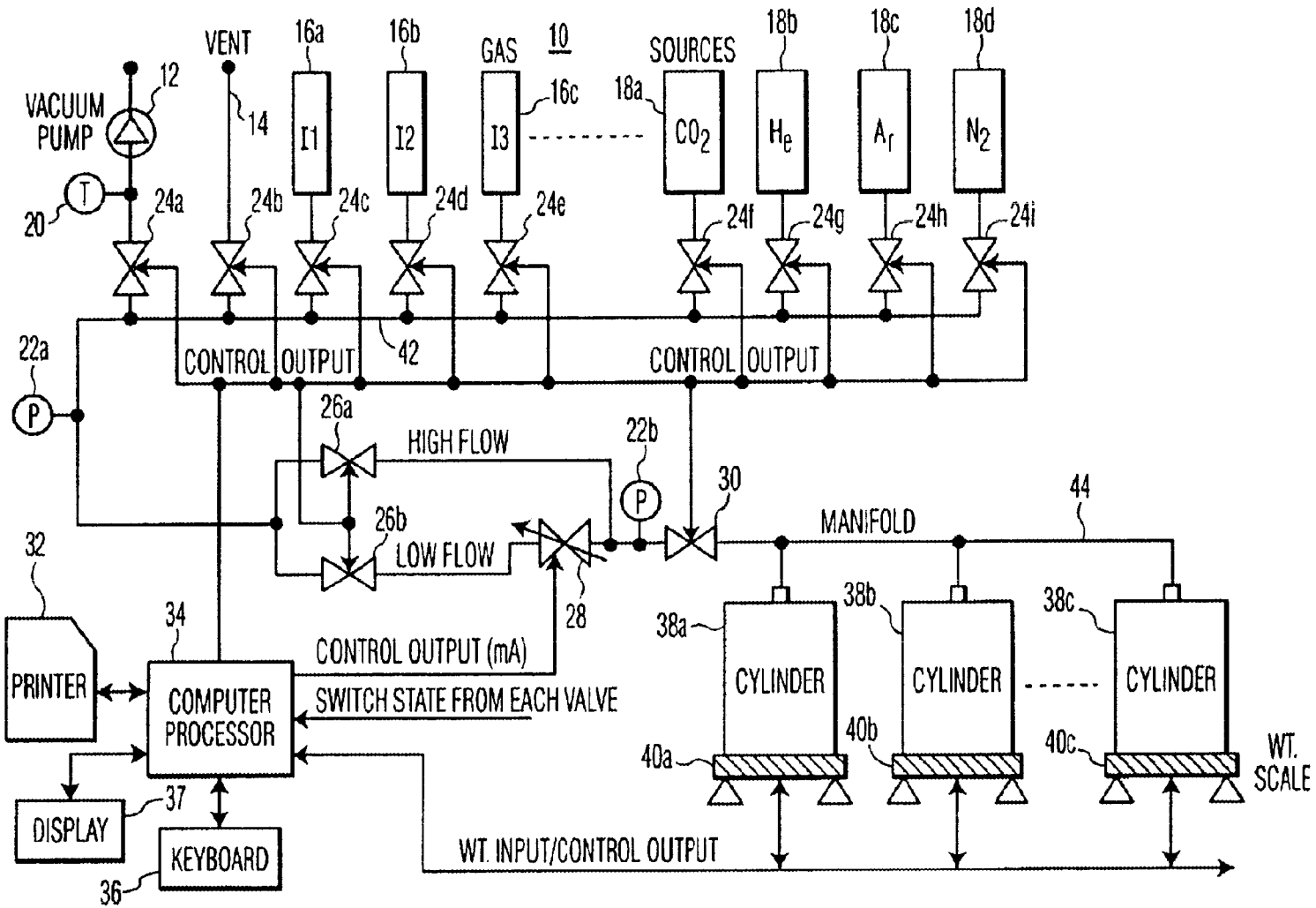
FIG. 1 is a block diagram of a gas cylinder filling system in accordance with an embodiment of the invention.

Referring to FIG. 1, there is illustrated a cylinder filling system, generally designated by the numeral 10. As shown, various sources of supply gas are provided in the system, for example, carbon dioxide source 18*a*, helium source 18*b*, argon source 18*c*, and nitrogen source 18*d*. Specialty gases, generally required in minute and accurate amounts, are provided, for example, by intermediate sources $I_1$–$I_3$, generally designated by the numerals 16*a*–16*c*.

A network of valves 24*c*–24*i*, connected to principal supply conduit 42, permit the selective connection of conduit 42 to a source gas. Valves 24*c*–24*i* are individually controlled by respective control output signals from processor 34. The processor, shown connected to keyboard 36 and printer 32, may be, for example, a personal computer (PC) executing a Microsoft operating system. Although not shown, proper interface requirements between processor 34 and each respective valve may be satisfied by adaptors residing within the processor or externally of the processor.

Vacuum pump 12 is connected to principal supply conduit 42 by way of control valve 24*a*. Interposed adjacent to control valve 24*a* is vacuum transducer 20. The vacuum transducer provides an electrical signal representing the amount of vacuum adjacent to control valve 24*a*, when the vacuum pump is operating. Pressure transducer 22*a* monitors system pressure, in psig units, present in principal supply conduit 42.

The principal supply conduit is connected to vent 14 by way of control valve 24*b*. When the control valve is opened by processor 34, gases present in principal supply conduit 42 are vented to the atmosphere.

Connected in parallel are high flow control valve 26*a* and low flow control valve 26*b*. As will be explained, a high rate of gas flow is provided from principal supply conduit 42 to manifold conduit 44 by way of control valve 26*a*. For more precise and fine control, a low rate of gas flow is provided from conduit 42 to manifold 44 by way of control valve 26*b*. Opening and closing of rate flow control valves 26*a* and 26*b* are controlled by a program executed by processor 34. Although not shown in FIG. 1, it will be appreciated that an input/output interface is provided to condition and buffer the signals inputted to and outputted from processor 34.

As will be explained, precise control of gas flow from principal supply conduit 42 (also referred to as system conduit 42) to manifold conduit 44 is provided by adjustable control valve 28. The adjustable control valve finely controls the amount of gas flowing to the manifold by a pressure converter residing on the control valve. The pressure converter (not shown) detects the amount of control current, in milliamperes, output from processor 34, and converts the current to a scaled pressure. The control current and, in turn, the scaled pressure, finely and accurately controls the valve. The program in processor 34 provides a resolution sufficiently fine to detect changes as low as one hundredth of a milliamp (0.01 mA) and controls gas additions as little as one tenth of a gram (0.1 gram), regardless of supply pressure or molecular weight of the gas.

As shown in FIG. 1, adjustable control valve 28 is connected in series with low flow control valve 26*b*. It will be appreciated that when high flow control valve 26*a* is open, both low control valve 26*b* and adjustable control valve 28 are closed. In this manner, gas flows to the manifold only through the high flow control valve. The control current from processor 34 maintains adjustable control valve 28 closed.

When the system switches to a low flow rate, by closing the high flow control valve and opening the low flow control valve, processor 34 also begins to adjust the control current flowing to adjustable control valve 28. As will be explained, processor 34 either subtracts a predetermined amount of current from, or adds a predetermined amount of current to the control current sent to the adjustable control valve. In this manner, the system may gradually slow the gas flow or gradually increase the gas flow to each cylinder being filled with a gas.

Continuing the description of FIG. 1 there is shown control valve 30 which provides yet another means of controlling gas flow between system conduit 42 and manifold conduit 44. Control valve 30 is a manual valve that may be used by the operator when the system is operated in a manual mode (for example, when operated to troubleshoot a leak). Manifold pressure, in psig units, is monitored by pressure transducer 22*b*.

Multiple fill cylinders 38*a*–38*c* are connected for filling through manifold 44. Each cylinder may be individually filled, or simultaneously filled with other fill cylinders, by a computer program which accounts and calculates the amount of supply gas required to accommodate single or multiple fill cylinders.

Scales 40*a*–40*c* are provided to continuously weigh cylinders 38*a*–38*c*, respectively. The scales communicate bidirectionally with processor 34, advantageously providing stability and accuracy of weight readings. As will be explained, the scales reach a state of equilibrium, before a weight is read by the processor. It will be appreciated that scales 40*a*–40*c* may be a single scale that is sufficiently large to accommodate multiple cylinders.

Cylinder filling system 10 (excluding gas sources 16 and 18, and excluding cylinders 38 and scales 40) may be packaged within an enclosure having volumetric dimensions less than 72 inches in height, 45 inches in width, and 24 inches in depth. System 10 is thus a portable system that may be easily transported from one location to another, and then may be readily connected to various gas sources and used to fill multiple gas cylinders.

A method of filling the cylinders with gas is shown in FIGS. 2*a*–2*i* and is generally designated by the numeral 50. The method may be PC based through Microsoft Windows. The method is a software program written, for example, in LabVIEW, which is a high level programming language. The program is preferably executed on a PC running at 1 Gigahertz.

Figure 2A:
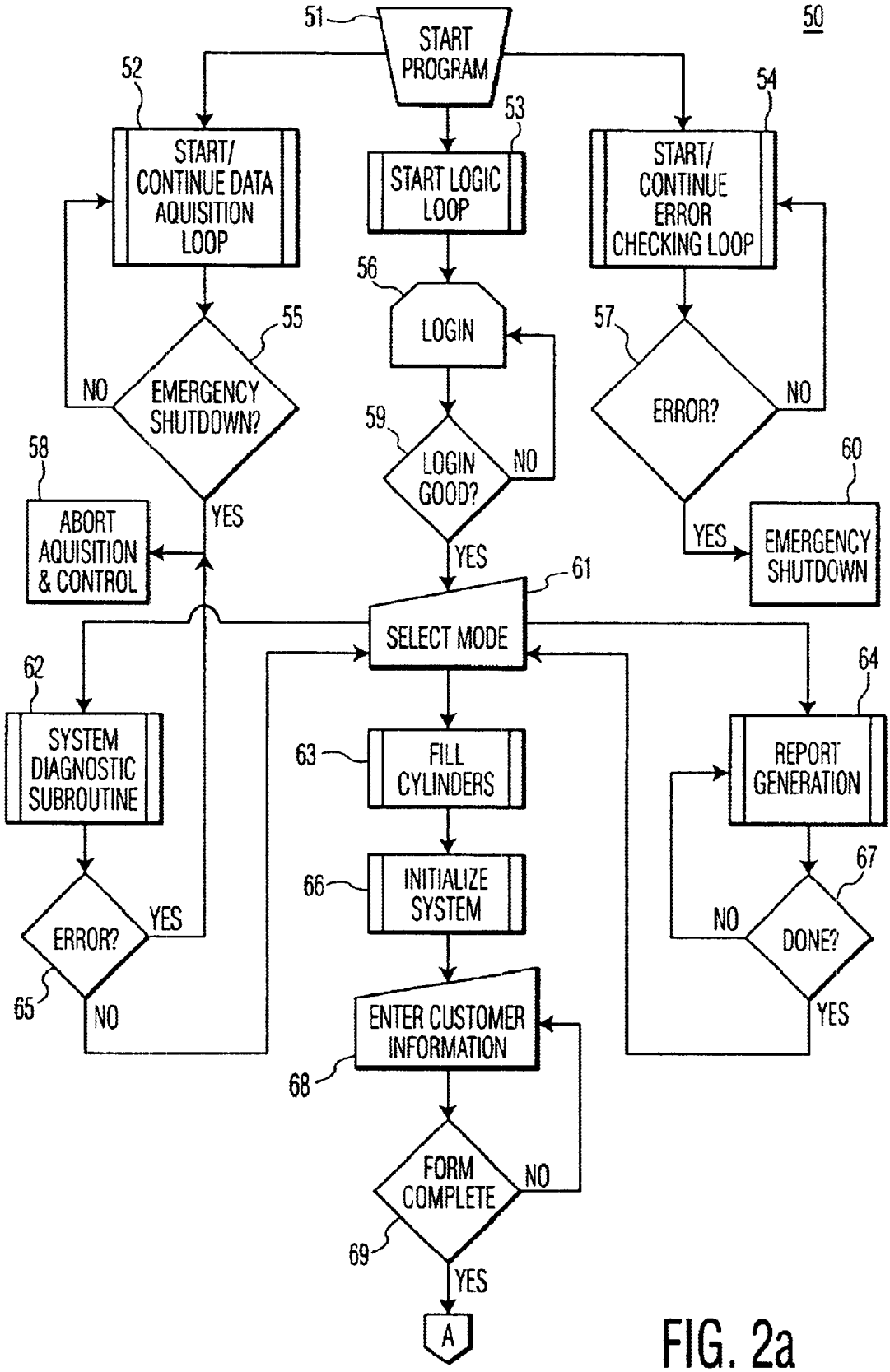
FIGS. 2*a* through 2*i* are block diagrams of a method of filling one cylinder or multiple cylinders with gas, in accordance with an embodiment of the invention.

Referring now to FIG. 2*a*, the operation for filling the cylinders will be described with reference to a flow chart of the program software by which processor 34 operates. The routine starts at 51 and branches concurrently to data acquisition loop 52, start logic loop 53, and error checking loop 54. The data acquisition loop continuously checks for an emergency shutdown in decision box 55 and aborts acquisition in step 58, if decision box 55 detects an emergency shutdown. Similarly, error checking loop 54 continuously checks for an error in decision box 57 and provides an emergency shutdown in step 60, if an error is detected.

The start logic begins with user log-in in step 56 and verification of valid log-in in step 59 by checking user password or ID. After successful log-in, the user may enter a system diagnostic routine in step 62. Upon detecting an error during diagnostics in step 65, the system loops back to step 58 and aborts acquisition. The user may also select a report generation mode in step 61 and prepare a report by way of a printer in step 64. After generating the report, decision box 67 loops the operation back to select mode 61, allowing the user to make another decision.

Figure 2B:
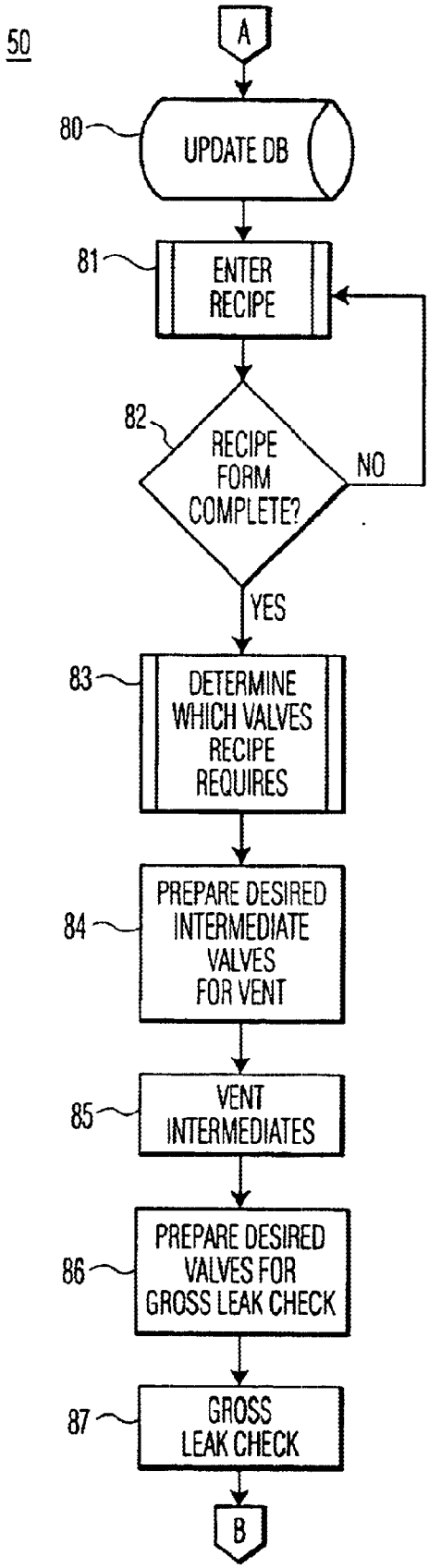
Figure 2C:
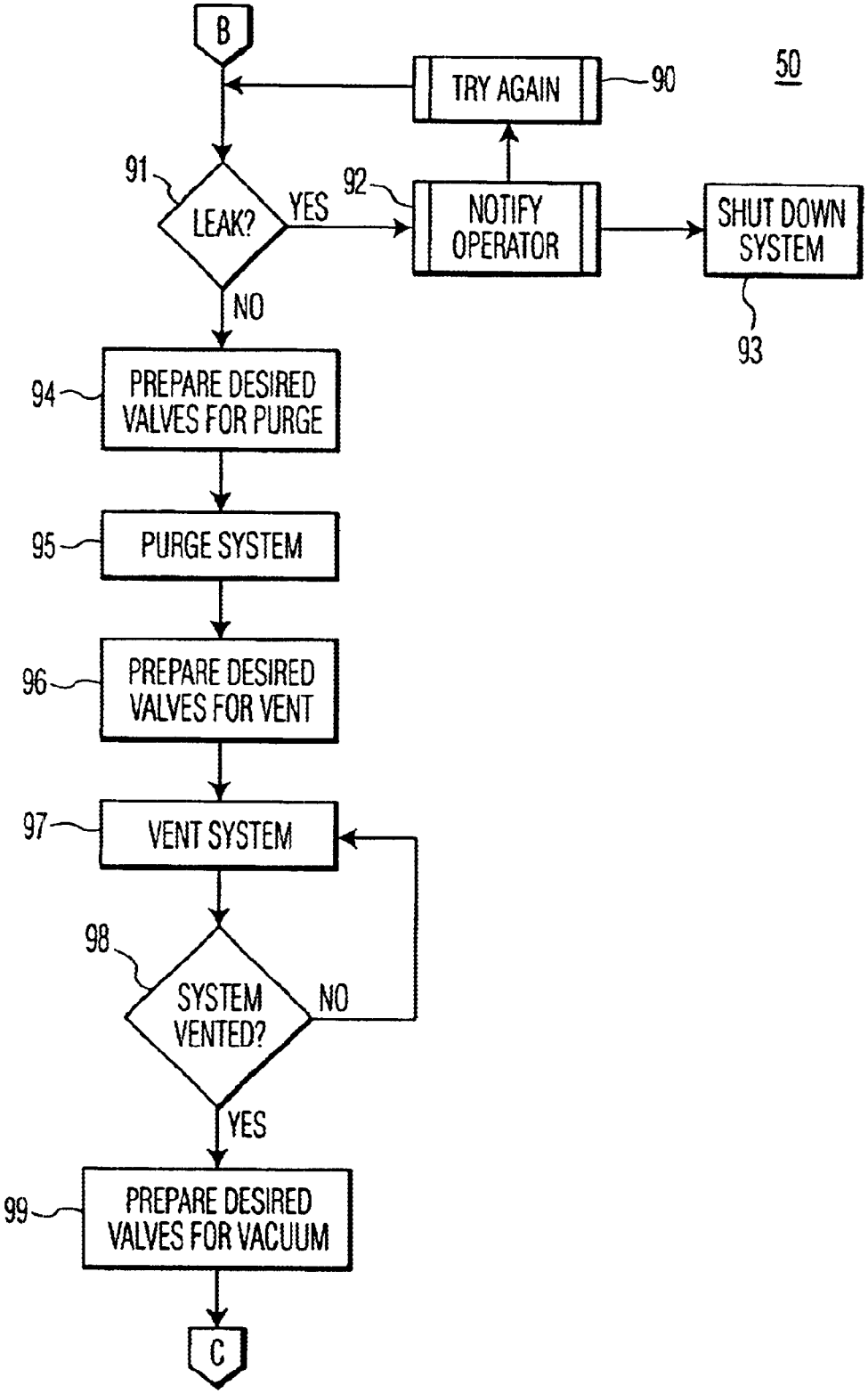

If the user selects to fill cylinders in step 61, the fill cylinder mode is entered in step 63. Initialization of the system begins in step 66, with the user entering customer information as prompted on the display. After the customer information is entered in step 68, and the program verifies that the information is complete in step 69, the data base is updated in step 80 (FIG. 2*b*). The program next prompts the user to complete the recipe form through step 81 and decision box 82.

The valves of the intermediate sources are vented (steps 83, 84 and 85) and checked for leaks (steps 86 and 87). If a leak is detected (step 91 in FIG. 2*c*), the user is notified (step 92) and the system is shut down (step 93). After eliminating the leak, the program allows the user to continue operation (step 90).

The desired valves are prepared for purging the system (step 94) and the system is purged (step 95) using an appropriate house gas that is consistent with the mix requirements (for example $CO_2$ or $N_2$). The system is then vented (steps 96, 97 and 98), and prepared for evacuation (step 99).

Figure 2D:
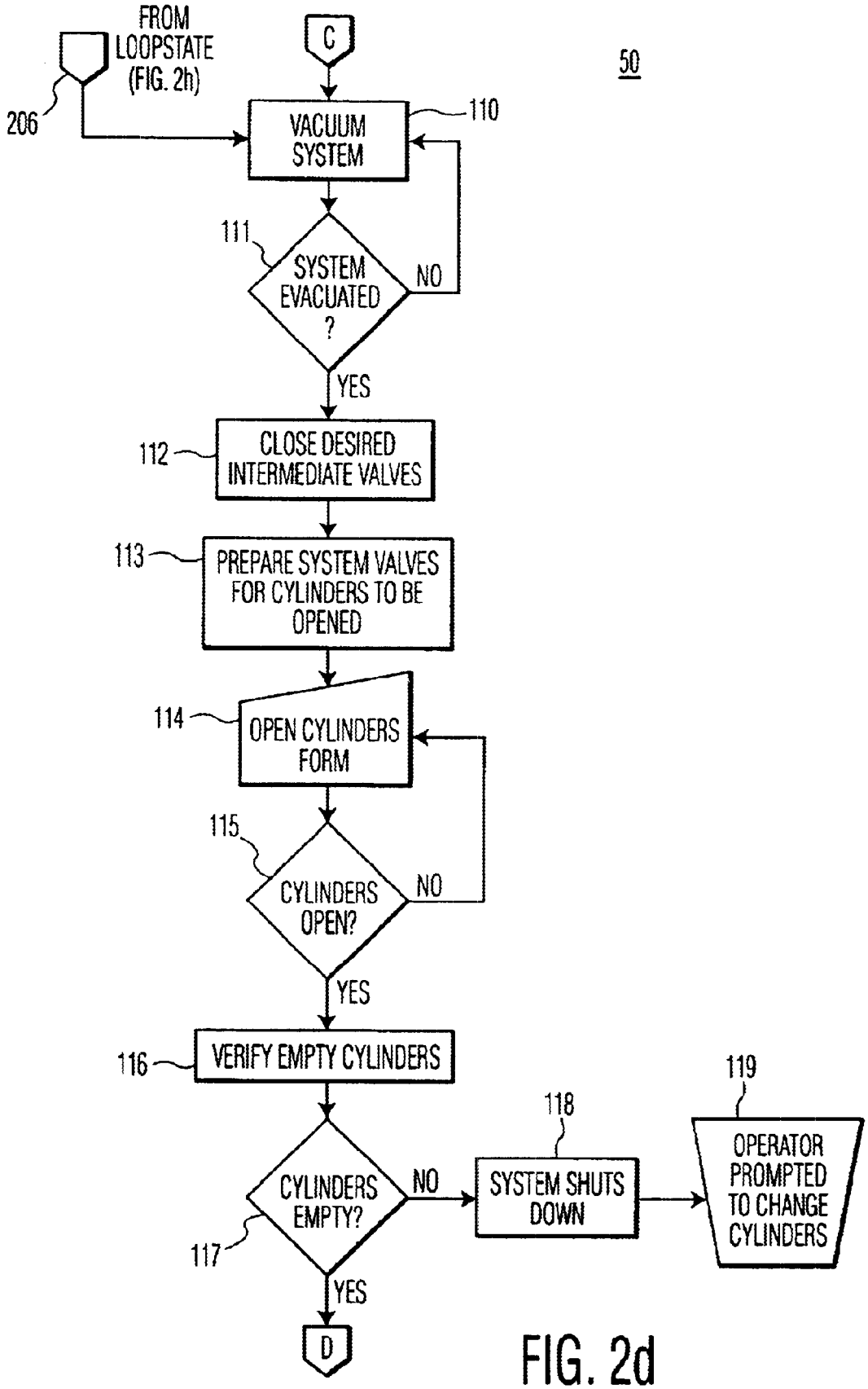

Continuing the description, reference is now made to FIG. 2*d*. The system is evacuated (steps 110 and 111) and the intermediate valves are closed, after verification of a good vacuum (step 112).

Having vented, purged and evacuated the system, operation proceeds to prepare the target cylinders for filling. The user is prompted to open the desired cylinders (steps 113, 114 and 115). Verification is made that the cylinders are empty (steps 116 and 117). If the cylinders are not empty, the program prompts the user to change cylinders and shuts down the system (steps 118 and 119).

Figure 2E:
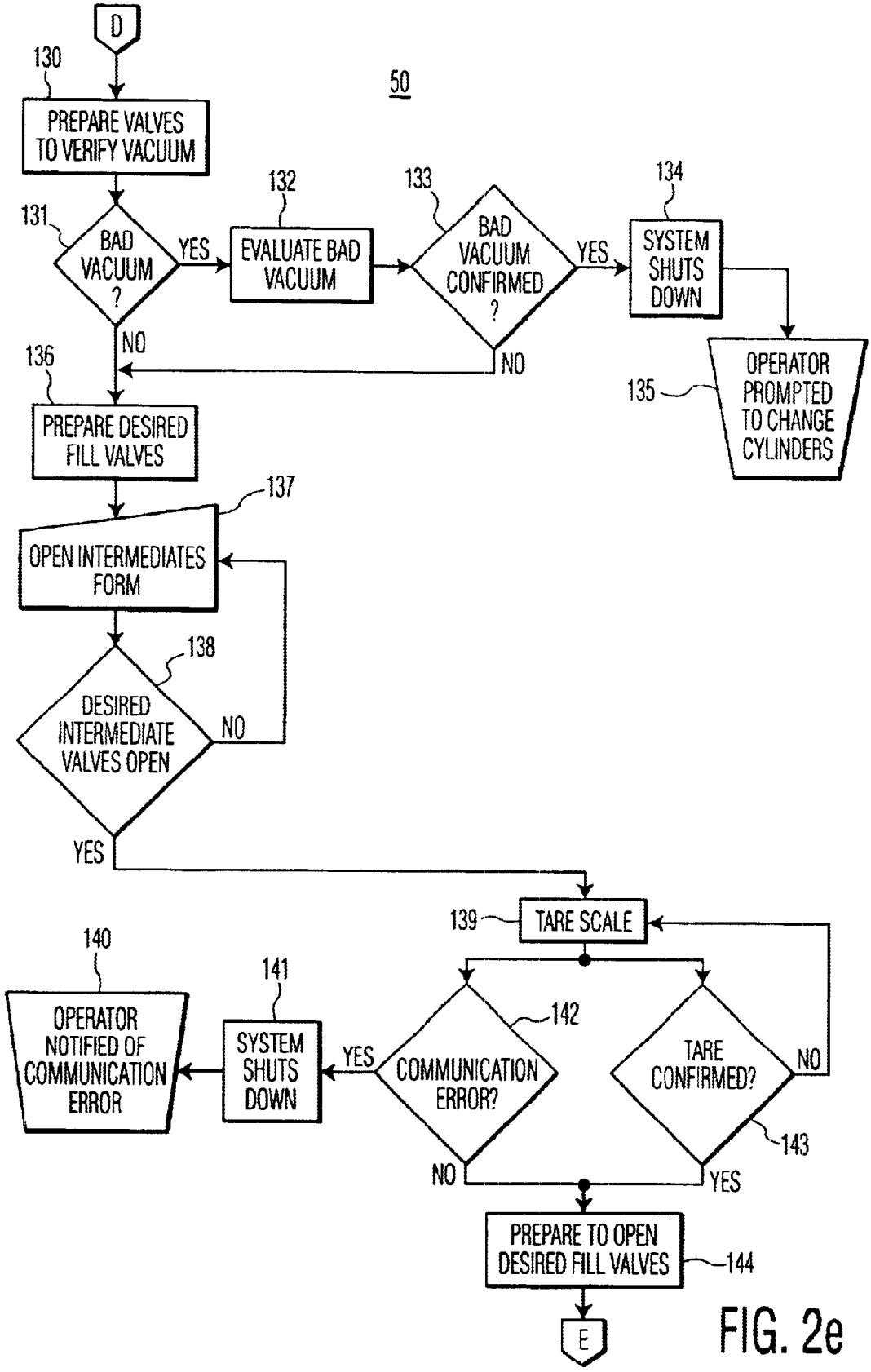

Continuing the description with reference to FIG. 2*e*, the program verifies that a vacuum is maintained in the system between the fill valves and the target cylinders (steps 130 and 131). The user is prompted to change cylinders, if a bad vacuum is confirmed (steps 132, 133, 134, and 135).

The desired fill valves are next prepared to be opened (step 136). The user is prompted, with a form displayed on the screen, to open the intermediate valves (steps 137 and 138). The weight of the cylinders are next determined by the scales. It will be appreciated that each cylinder may have a separate dedicated scale, as shown in FIG. 1, or multiple cylinders may share a single scale. The tare weight of the cylinder is determined and (for example) set to zero as a reference (steps 139 and 143).

The program verifies that proper signal communication exists between each scale and computer processor 34 (FIG. 1). If an error is detected in communications between the scale and the processor, the system shuts down and the user is notified (steps 140, 141 and 142). If communication is proper and the tare weight is confirmed, the desired fill valves are opened, one valve at a time (steps 144 and 150 shown, respectively, in FIG. 2*e* and FIG. 2*f*). Checks for proper communication are performed sequentially each time a new fill valve is opened to deliver a respective gas component to the cylinder or cylinders.

Figure 2F:
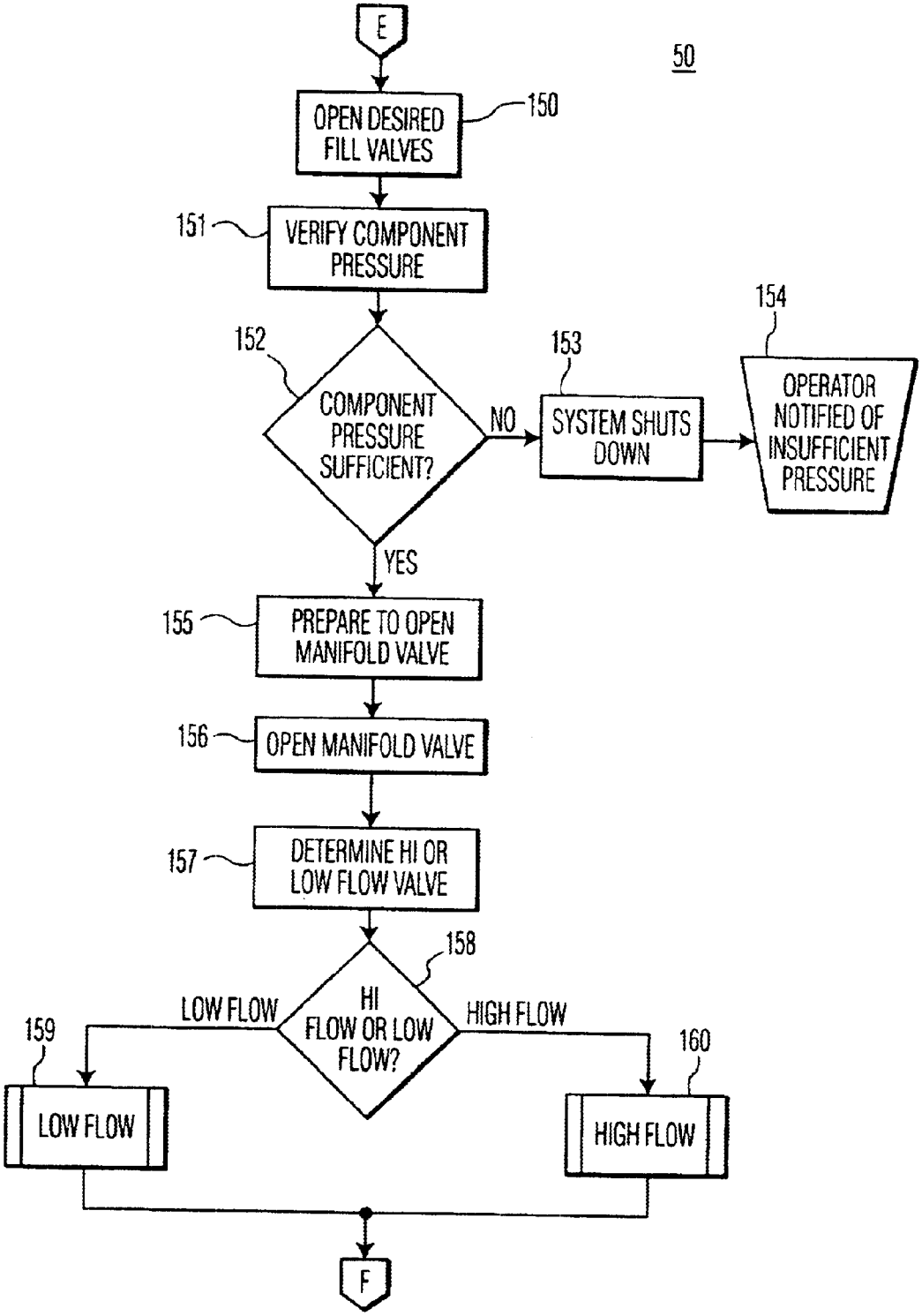

Next, as shown in FIG. 2*f*, pressure in each of the conduits having an opened fill valve is verified (steps 151 and 152). If pressure is inadequate, the system is shut down and the user is notified (steps 153 and 154).

The manifold valve is opened in steps 155 and 156. The program then determines (steps 157 through 160) whether to open high flow valve 26*a* or low flow valve 26*b* (as shown in FIG. 1).

Assuming that the high flow valve is opened first (steps 171 in FIG. 2*g*), a specific gas is supplied to one or multiple cylinders at a high flow rate. The weight scale continuously measures the present weight of each cylinder, as gas is being supplied to the cylinder. The measured weight is continuously and, at a periodic rate, sent to the processor for update (step 173). If a communications error is detected, the system is shut down, all valves are placed in a predetermined shutdown state, and the user is notified (steps 175, 176 and 180).

As the present weight of a cylinder approaches its target weight, or is within a predetermined range of the target weight (as determined in steps 179 and 185), the system is equalized and switched to the low flow rate (steps 187, 189 and 190). In the exemplified embodiment shown in FIG. 1, when the actual weight of each cylinder (one cylinder or multiple cylinders), as it is being filled, approaches its target fill weight, within a predetermined amount (for example, 30 grams or less) the method switches to the low flow rate. In addition, in a situation of only one cylinder being filled, when the system pressure is greater than 1000 psi, and the actual weight of the cylinder being filled approaches its target weight, within another predetermined amount (for example, 60 grams or less) the method switches to the low flow rate. In other situations, the high flow rate valve may be opened and the low flow rate valve closed.

If, at the start of filling one cylinder, the desired weight is less than 30 grams, or the desired weight is between 30 grams and 60 grams and the system pressure is greater than 1000 psi, then the low flow rate valve is opened at the start without first opening the high flow rate valve. If, at the start of filling multiple cylinders, the desired weight is less than 30 grams, then the low flow rate valve is opened at the start without first opening the high flow rate valve. Otherwise, the high flow rate valve is opened first.

When filling a primary standard, the method uses the following criteria to switch from high flow to low flow:

(A) If the system pressure is less than 500 psi, the switch point is set to the target weight less 10% of the system pressure;

(B) If the system pressure is greater than 500 psi, and more than four cylinders are being filled, the switch point is set to the target weight less 100 grams; and (C) If the system pressure is greater than 500 psi and less than five cylinders are being filled, the switch point is set to the target weight less 40 grams.

When filling a certified standard, the method uses the following criteria to switch from high flow to low flow:

(A) If the system pressure is greater than or equal to 500 psi, the switch point is set to the target weight less 20 grams;

(B) If the system pressure is less than 500 psi, and more than four cylinders are being filled, the switch point is set to the target weight less 20 times the number of target cylinders; and (C) If the system pressure is greater than or equal to 500 psi, the switch point is set to the target weight less 20 grams.

Figure 2G:
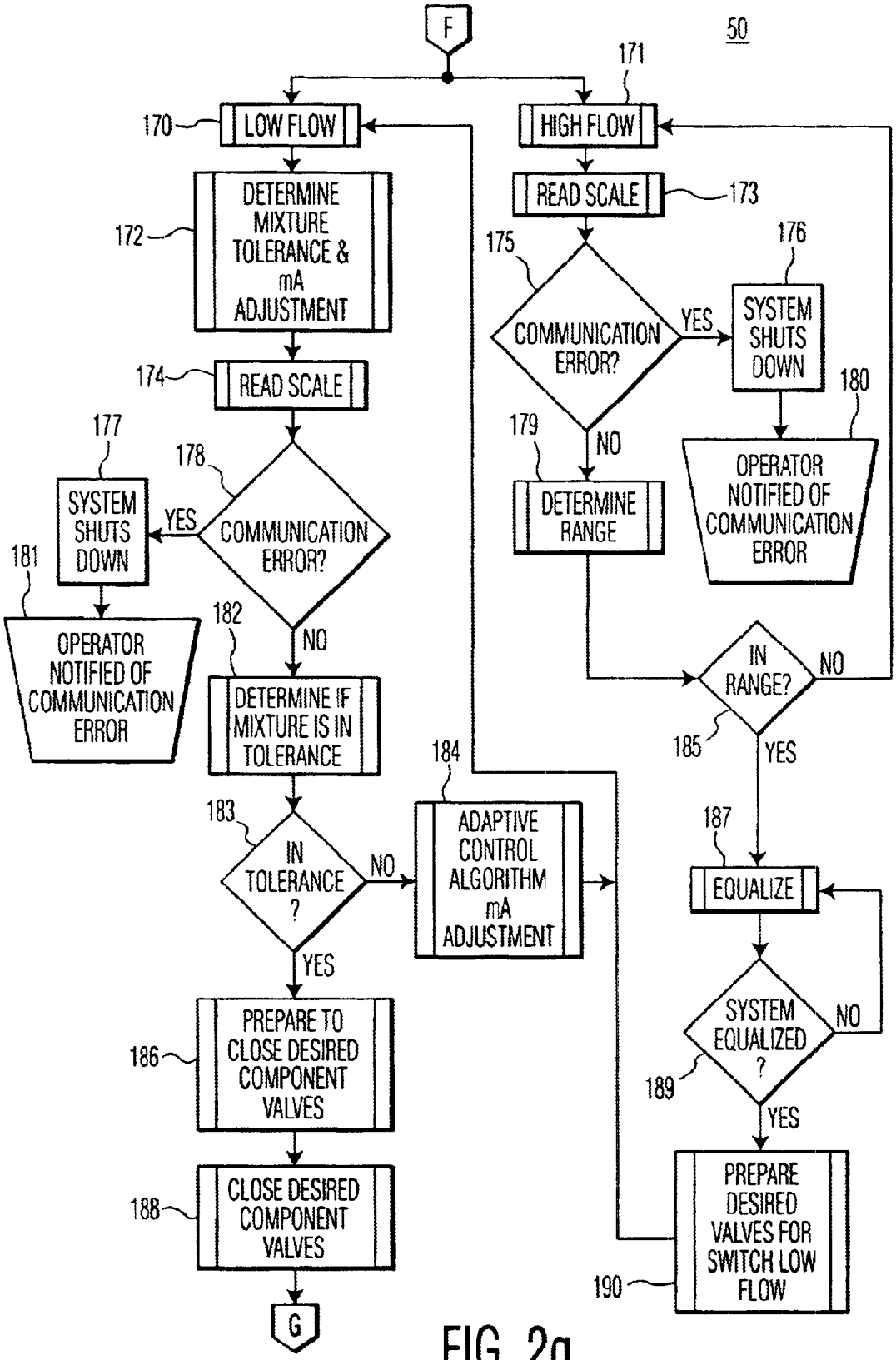

After closing the high flow valve and opening the low flow valve, operation proceeds from step 170, shown in FIG. 2*g*. As will be explained in detail, flow of gas to the cylinder is carefully controlled from processor 34 by controlling the amount of current (in milliamperes) provided to control valve 28 (FIG. 1). Based on a required mixture tolerance, a milliampere (mA) adjustment value is calculated in step 172 for adaptively controlling the amount of gas flowing into the cylinder (explained later by referring to FIGS. 9 and 10).

The weight scale is periodically and continuously read in step 174. If a communications error is detected, the system is shut down, all valves are placed in the predetermined shutdown state, and the user is notified (steps 177, 178 and 181). The program in steps 182 and 183 determines if the mixture is within tolerance. If the mixture is not within tolerance, operation branches to step 184, which then loops back to step 170, as shown in FIG. 2*g*. As will be explained (with reference to FIGS. 6 and 7), an adaptive control algorithm, provided by step 184, adds or subtracts a mA adjustment value to or from the mA control output signal provided to control valve 28. This adaptive control continues, until the present weight of the cylinder being filled is within a tolerance band of the target weight of the cylinder.

After the mixture is within the tolerance band, a source valve (for example, valve 24*c*) is closed, thereby shutting off further gas flow into the system (for example, gas flow from intermediate source $I_1$). The closing of a source valve (component valve) is performed by steps 186 and 188.

Figure 2H:
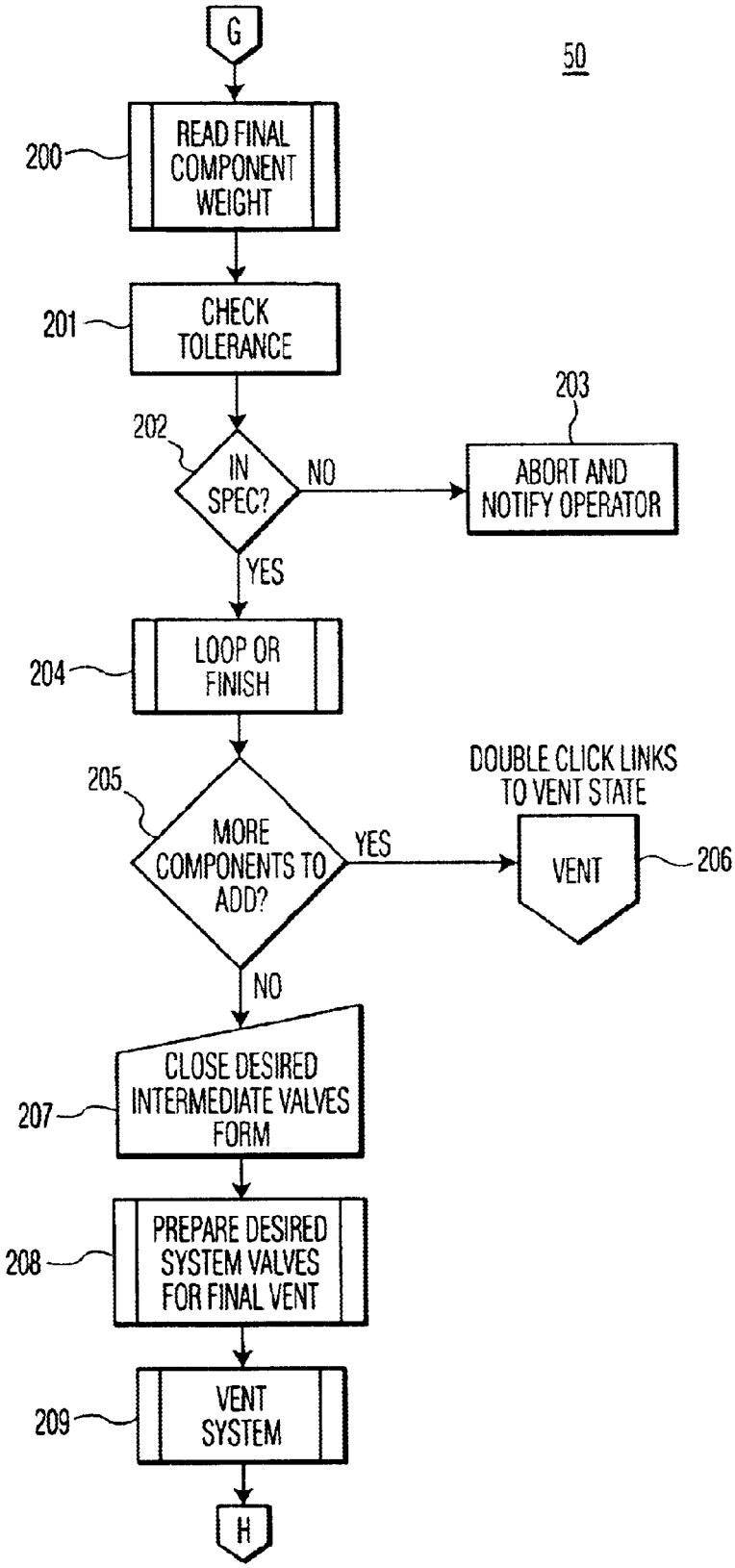
Figure 2I:
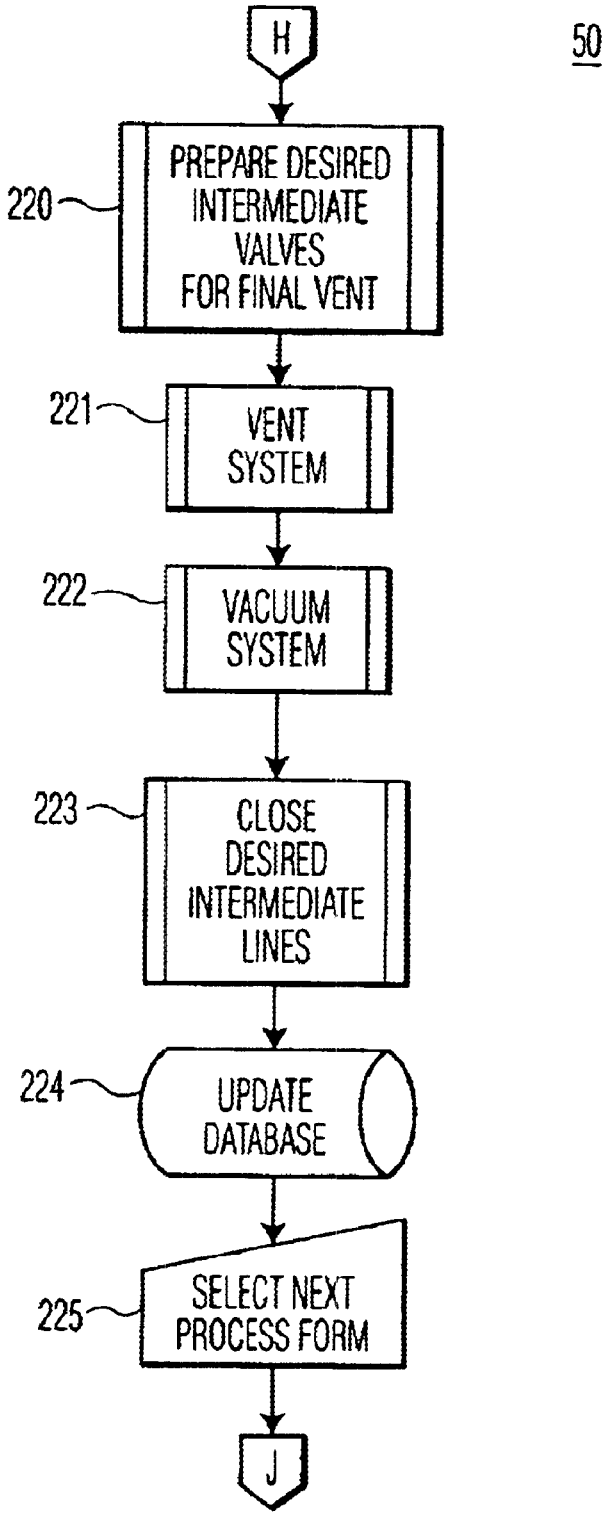

Referring next to FIGS. 2*h* and 2*i*, the program enters steps 200 through 202 to check whether the final settled component weight is within tolerance. If the final component weight is not within tolerance, operation is aborted and the user is notified (step 203). If the component weight is within tolerance, the program determines whether other gas components are required to be added into the cylinder (steps 204 and 205). If more gas components are required, the program branches to step 206 (loop state 206 in FIG. 2*d*) for preparation of the cylinder to receive another gas component.

If no more gas components are required, the close-intermediate-valve form on the display is opened (step 207) and, after the user verifies that the intermediate valves are closed, the system is vented (steps 208 and 209). The intermediate valves are vented (steps 220 and 221), the system is vacuumed (step 222) and the intermediate lines are closed (step 223). Finally, the database is updated (step 224) and, if available, the next process form is selected (step 225).

Figure 3:
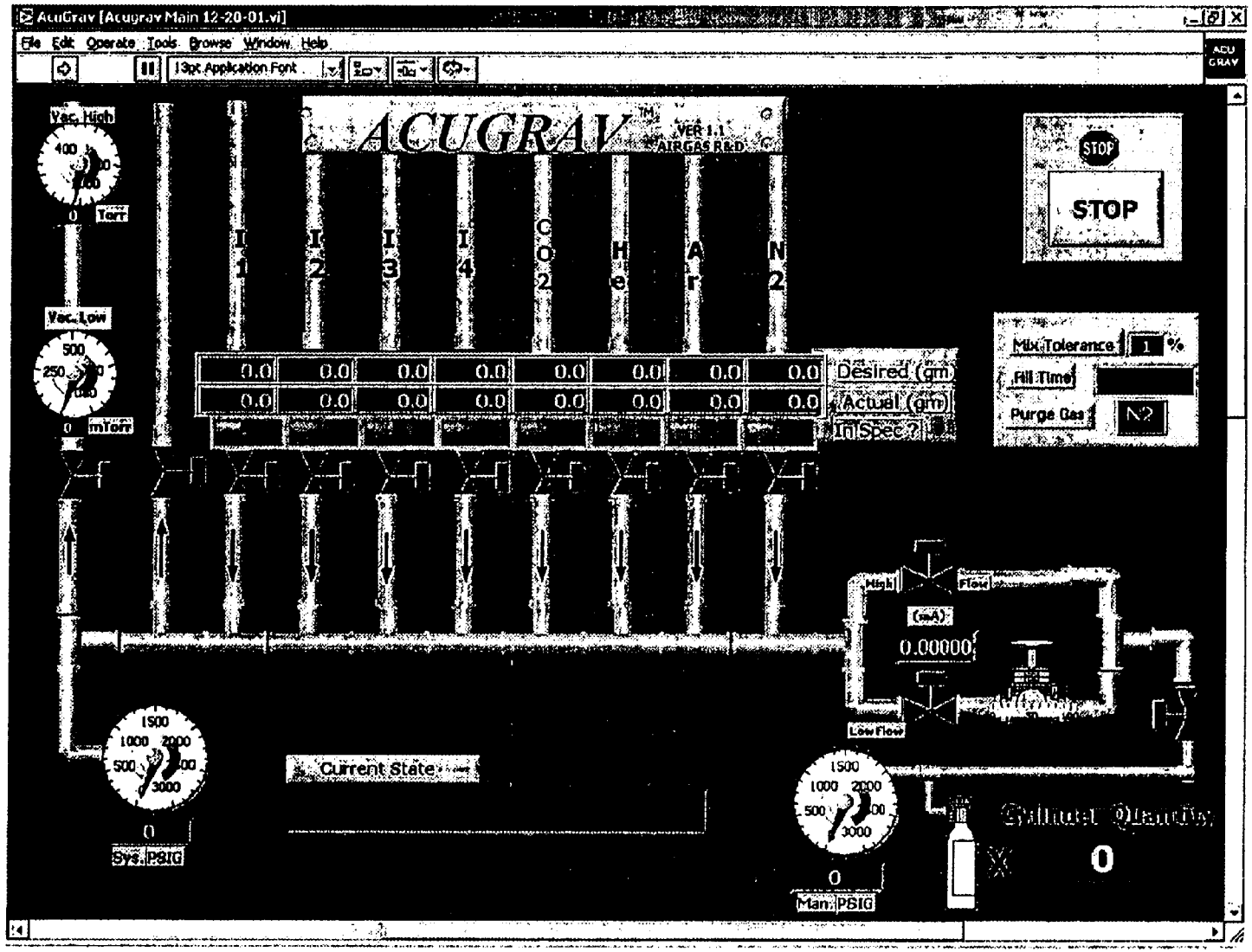
FIG. 3 is an exemplary embodiment of a computer display of a virtual instrument (VI) depicting portions of the system shown in FIG. 1, in accordance with an embodiment of the invention.

The program executed by processor 34 generates several display screens which are displayed by a monitor (not shown) for guiding the user in setting up and operating the system. The program reports on the progress and status of the system during operation and produces reports in connection with a filling operation. An example of overall system operation and status displayed on a screen is shown in FIG. 3. As shown, the display, generally designated by the numeral 300, illustrates a configuration of the filling system, similar to system 10 shown in FIG. 1. The source gases ($I_1$–$I_3$ and, for example, $CO_2$, He, Ar and $H_2$) are identified on the display. The desired amount in grams (target amount) of a specific gas and the actual amount in grams (present amount) of the specific gas are shown in two separate rows at the middle portion of the screen. Whether the specific gas is in-tolerance or out-of-tolerance is also indicated in a third row.

The present or current status of the system is shown by way of digital gauges showing analog displays depicting readings sensed by vacuum transducer 20 of FIG. 1 in Torrs or milliTorrs, and readings sensed by pressure transducers 22*a* and 22*b* of FIG. 1 in psig. Whether the high flow valve (26*a* of FIG. 1) or the low flow valve (26*b* of FIG. 1) is open is displayed to the viewer. The valve control signal, indicating current in mA, is also displayed. The filling cylinders which are connected to the manifold are also identified.

Finally, on the right side of display 300, emergency shutdown is indicated by a STOP legend. The mix tolerance required for filling a particular customer request is also indicated. The fill time, as well as the purge gas, are identified.

The software program executing method 50 of FIGS. 2*a*–2*i* moves all necessary information from one routine to another routine as clusters of information. The clusters include various data types which are stored as arrays, scalars or strings. Since all necessary information is moved in clusters, updates may easily be made to the entire program without requiring large-scale revisions. The main clusters are "error in", "error out", "running parameters in", "running parameters out", "actual weight in", and "configuration settings".

The "error in" cluster accepts error or warning information from previously called routines and is used by a currently executing routine. The "error out" cluster passes error or warning information out of a routine and is to be used by a future executing routine. The error cluster provides critical data or information to the user so that errors may be corrected and system operation may be continued. Similarly, the "running parameters in" cluster contains data or information obtained from previously called routines for use by the presently executing routine. The "running parameters out" cluster passes data or information out of a routine to be used by a future executing routine. Accordingly, the clusters described may be data stored in buffers which are continuously updated by a routine fetching data from the buffers and modifying the data during execution. Since the running parameters cluster identifies and defines repetitive data types used in the program, routines may be updated easily by adding or deleting a data type from the cluster.

Figure 4:
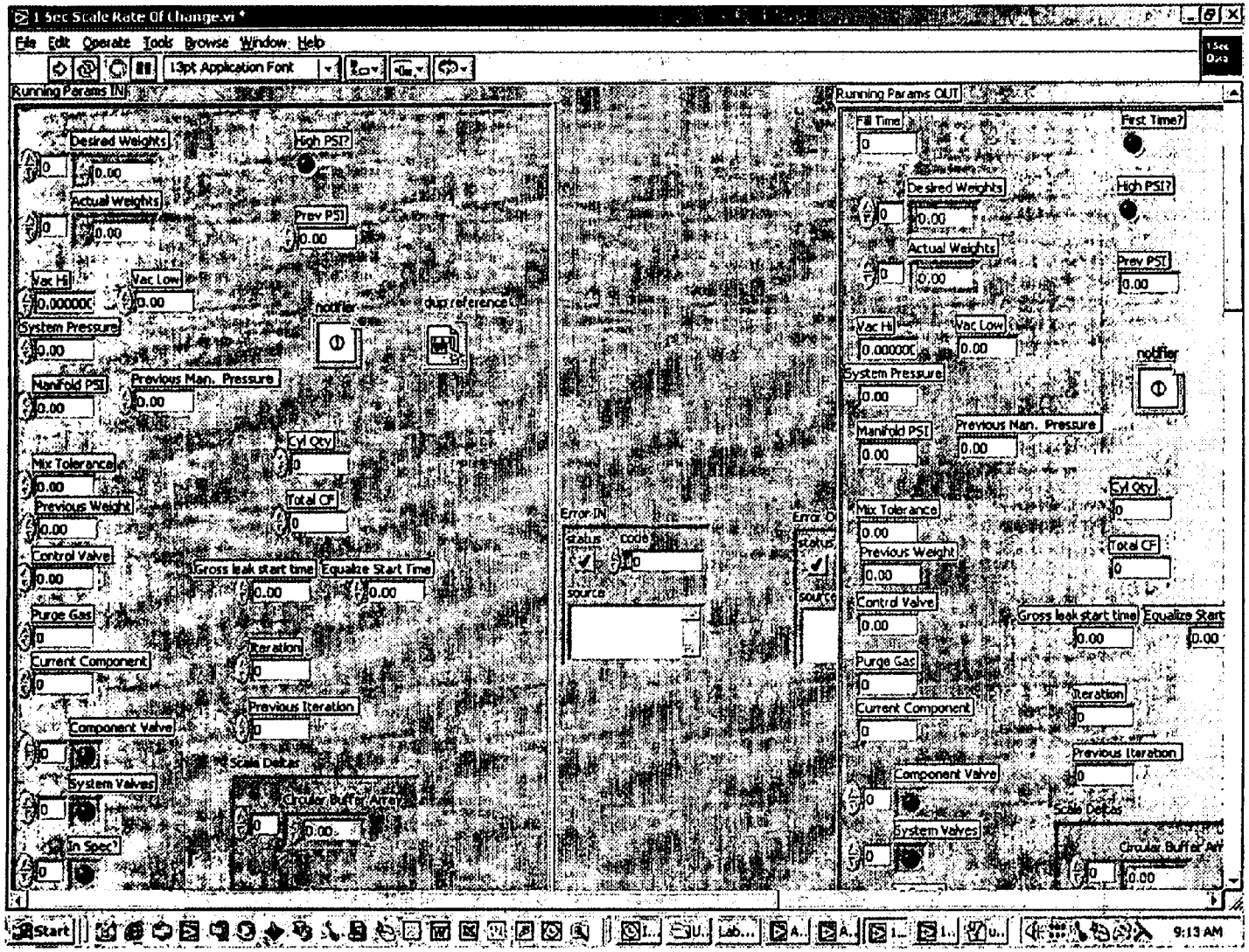
FIG. 4 is an exemplary embodiment of a computer display showing clusters of input data and output data available for viewing by a user during operation of the cylinder filling system shown in FIG. 1, in accordance with an embodiment of the invention.

The clusters of information used by the processor in executing the routines are listed in Table 1. The types of information and data included in each cluster is also listed and described in the table. These clusters of information may also be viewed when programming system operation, thereby providing the programmer with immediate status of the operation of the system. All the clusters (except "configuration settings") may be viewed on display screen 400 shown in FIG. 4.

The software routines executed by processor 34 may be implemented in Microsoft Windows using G programming language. G language is a general-purpose programming language including libraries for data acquisition, GPIB and serial instrument control, data analysis, data presentation and data storage. G differs from C or Basic, for example, in that G is a graphical programming language, while C or Basic is a text-based language and includes lines of code.

G programs are called virtual instruments (VIs), because their appearance imitates actual instruments. A VI includes a user interface called a front panel since it simulates a panel of a physical instrument. The front panel may contain knobs, push buttons, other controls and indicators. A user may enter data using a mouse and a keyboard. The user may view results of the entered data on the computer display. FIG. 3 shows an example of a front panel depicting portions of system 10. The front panel includes various controls and indicators available to the user during the operation of filling a cylinder with gas. The user may also observe the flow of gas from one point to another point. Each type of gas may be shown in a different color so that the viewer (user) may more easily observe the operation.

Figure 5A:
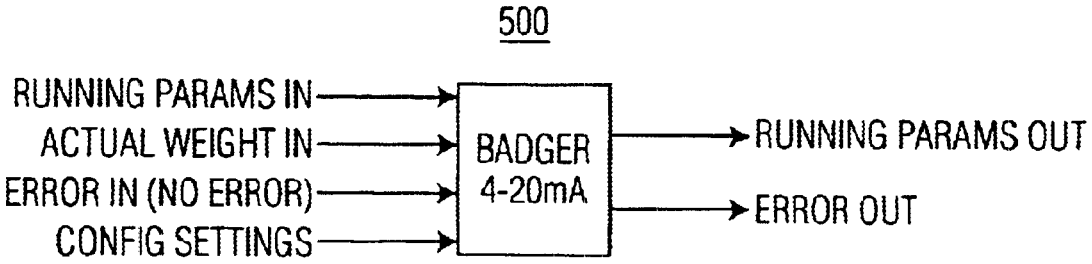
FIGS. 5*a*–5*b* and 6 depict an exemplary embodiment of a virtual instrument as it modifies input data to produce output data for controlling an adjustable control valve in the system of FIG. 1, and in accordance with an embodiment of the invention.

A VI may also include a block diagram that shows various modules of the system interfacing with the controls and indicators and. The VI may also include hidden modules that perform some operation, for example a computation or a loop construct. The block diagram generally shows the input data on the left side and the output data on the right side of the diagram. The VI generally executes from left-to-right. An example of a block diagram of a VI is shown in FIGS. 5*a* and 6 (Badger Control) and is discussed below.

Turning next to detailed descriptions of the software routines executed by the processor, the Badger control routine (Badger Control. VI) will now be described. It will be appreciated that Badger Control provides the control current signal (control valve numeric shown belonging in the "running parameters out" cluster of Table 1). The control valve signal is sent to control valve 28, shown in FIG. 1, for linearly and finely adjusting the setting of the control valve. The signal may vary, for example, from 4 mA (valve completely closed) to 20 mA (valve completely open).

Figure 5B:
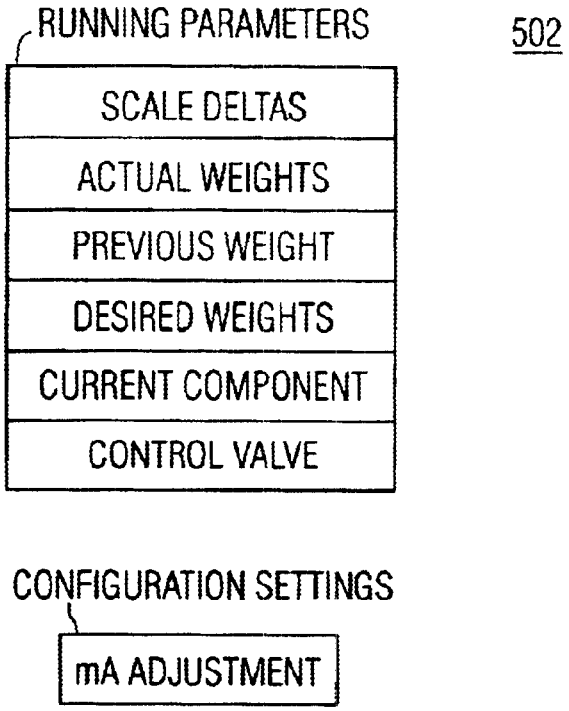

The Badger control routine operates using the "running parameters in" cluster, "actual weight in" cluster, "error in" cluster and the "configuration setting" cluster, as defined in Table 1. Upon completion of the operation, Badger control modifies the "running parameters in" to provide the "running parameters out" and "error out". This is schematically shown in FIG. 5*a*. More specifically, five items from the "running parameters in" cluster, one item from the "configuration settings" cluster and the "actual weight in" cluster are operated on by Badger control, as shown in FIG. 5*b*. One item from the "configuration setting" cluster, namely mA adjustment, is generated by another routine, which will be explained later. The seven items of data shown in FIG. 5*b* are used to increase or decrease the amount of current sent to a pressure converter on the adjustable control valve. As previously described, the current is converted to a scaled pressure on the adjustable control valve. The resolution of this routine is such that changes as low as one hundredth (0.01) of a mA can be detected, resulting in the ability to add as little as a tenth (0.1) of a gram of any gas, regardless of supply pressure or molecular weight.

Figure 6:
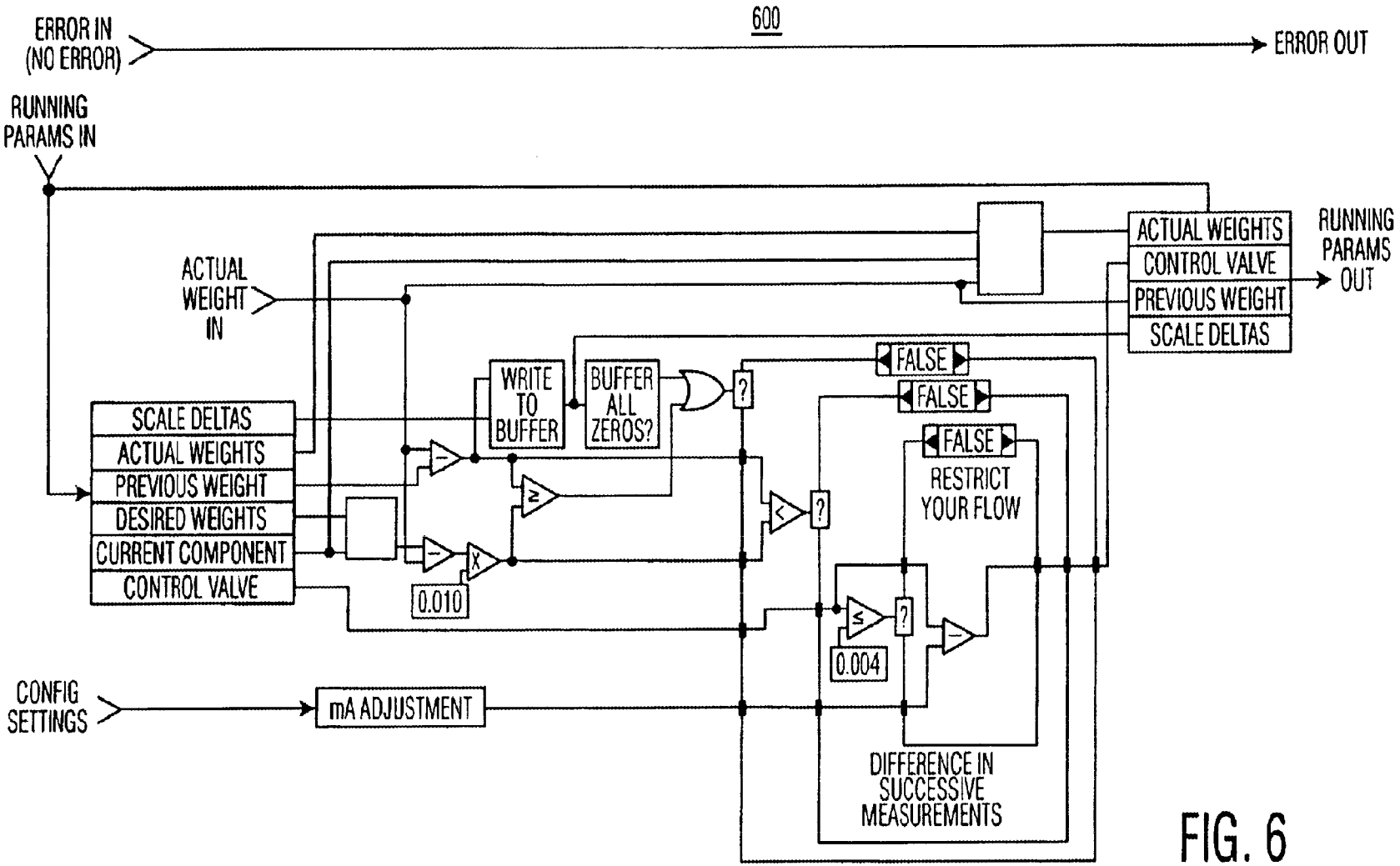

A state diagram, generally designated as 600, of the Badger control routine is shown in FIG. 6. This state diagram may be better understood with the following explanation of the operation of the Badger control routine.

Figure 7:
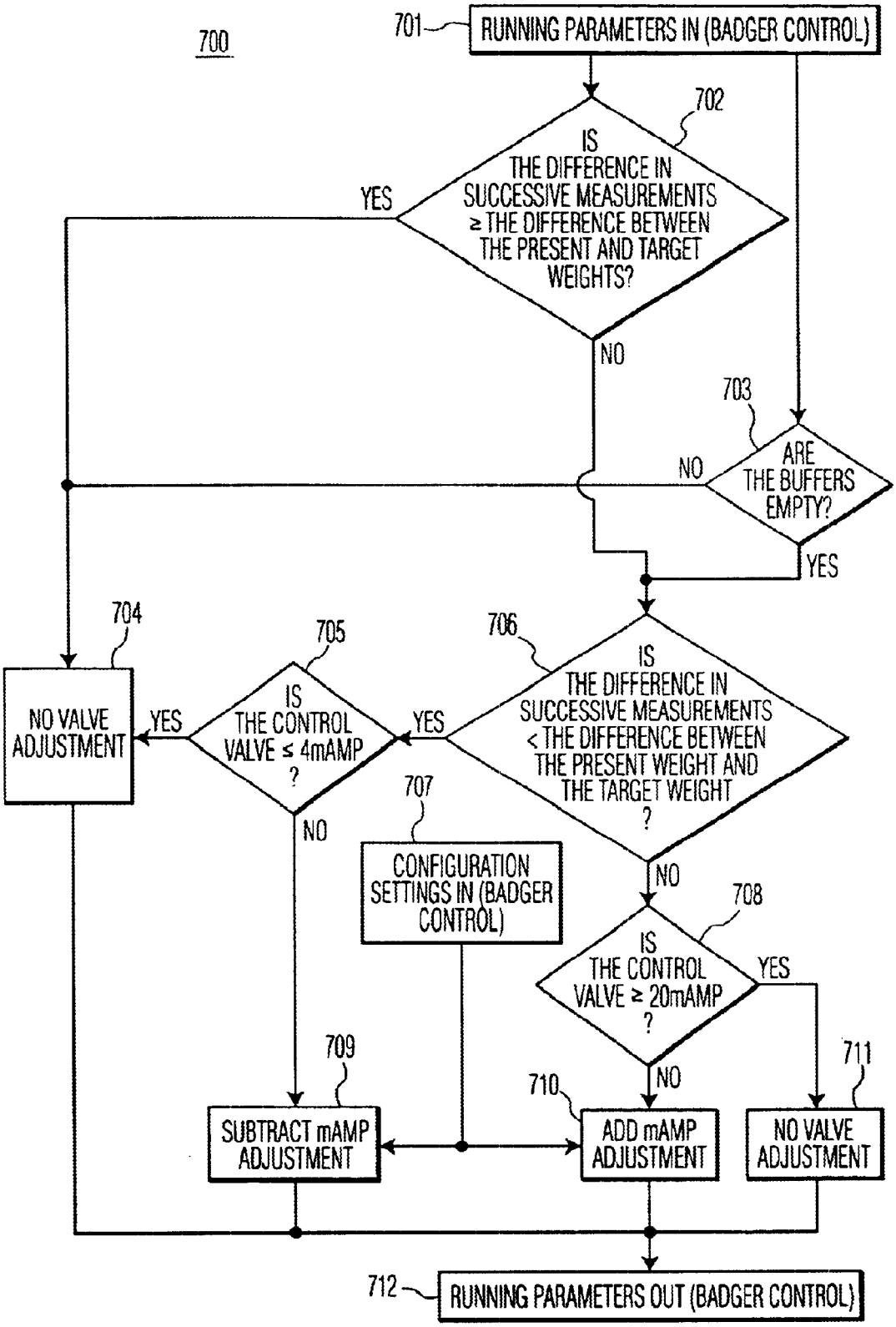
FIG. 7 is a flow diagram depicting a method (Badger control routine) of controlling the adjustable control valve in the system exemplified in FIG. 1, in accordance with an embodiment of the invention.

The operation of the Badger control routine, generally designated with the numeral 700, is shown as a flow diagram in FIG. 7. As shown, the routine or method accepts information or data from "running parameters in" in block 701 and "configuration settings" (mAmp adjustment) in block 707. Decision box 702 determines whether the difference in successive measurements (actual weight minus previous weight) is greater than or equal to the difference between the present weight (actual weight) and target weight (desired weight). If true, the method branches to step 704 and applies no valve adjustment control. In parallel with decision box 702, the method in decision box 703 determines whether the buffers (scale deltas) are empty, or have values that are approximately zero (in other words, the differences between successive actual weights are approximately zero). If false, the method branches to step 704 and applies no valve adjustment control.

If, on the other hand, decision box 702 determines a false condition, or decision box 703 determines a true condition, the method branches to decision box 706. Decision box 706 determines whether the difference in successive measurements is less than the difference between the present weight and the target weight. If true, the method reaches decision box 705 to determine if the control valve numeric is less than or equal to 4 mA (valve completely closed). If less than or equal to 4 mA, no valve adjustment is made. If the control valve numeric is greater than 4 mA, however, the method reaches step 709 and subtracts a predetermined fixed value of mA (current) from the control valve numeric.

It will be appreciated that the predetermined fixed value of mA is the "mA adjustment" numeric residing in the "configuration settings" cluster. The manner in which the "mA adjustment" numeric is calculated will be described later. It will also be appreciated that when subtracting the "mA adjustment" numeric from the "control valve" numeric, the control valve is adjusted to reduce the gas flow rate flowing to the manifold.

If decision box 706 determines that the difference in successive measurements is not less than the difference between the present weight and the target weight, the operation reaches decision box 708. Decision box 708 determines whether the control valve numeric is greater than or equal to 20 mA (valve completely open). If the valve is completely open, step 711 is reached and no valve adjustment is made. If the valve is not completely open, step 710 is reached and a predetermined fixed value, based on the calculated "mA adjustment" numeric is added to the "control valve" numeric, thereby increasing the flow rate to the manifold.

The Badger control routine continues cycling between step 701 and step 712 until the difference between the present (actual) weight and the target (desired) weight diminishes to a set point. As this happens, the sampling rate overtakes the difference and the rate of change becomes so small that the difference between successive scale samples approaches zero. As the difference in successive samples approaches zero, the "scale deltas" in the running parameters cluster is filled with zeros (in other words, the buffers are empty, as determined by decision box 703 of FIG. 7).

Although not shown in FIG. 7, the difference between the desired (target) weight and the actual (present) weight is scaled (or multiplied) by a fixed value, for example, 0.01. It is actually this scaled difference that is checked against the successive measurements in operation 700. This multiplier is essentially a timing variable used to achieve equilibrium with the sampling rate of the data acquisition system. The logic used in method 700, including the scaled multiplier, is shown in Table 2.

It will be appreciated that the "scale deltas" shown in Table 2 is a 10-element array serving as a buffer for the last 10 scale deltas. A scale delta is defined, as shown in Table 1, to be the difference between the actual weight and the previous weight (successive measurements of the scale). Since this is a 10-element array and weight is sampled once every tenth of a second, the scale (balance) must remain unchanged for only one second to fill up the array with zeros. The Badger control routine may cycle once per second, as the sampled weights fill up the array every one second.

In an embodiment of the invention, the Badger control routine begins with the adjustable control valve closed (that is, the processor, via an appropriate interface, provides less than 4 milliamps to the valve). In order for the processor not to apply control to the valve, two conditions are required. The first condition requires that the scale buffer, which is a ten element array populated with ten values, each obtained by successively subtracting an actual weight from a previous weight, should each be approximately zero. Another condition requires that the actual weight minus the previous weight is greater than or equal to the desired weight minus the actual weight (this value is also scaled by 0.01, which is essentially a timing variable used to equilibrate the routine with the sampling rate of the data acquisition system). If either of these conditions are true, the Badger control routine applies no control.

When one of these conditions becomes false, however, the method determines whether to add amperage to, or subtract amperage from, the control current provided to the control valve. The scaled difference between the desired weight and the actual weight diminishes as the balance approaches the set point. As this happens, the sampling rate overtakes the difference, and the rate of change becomes so small that the difference between successive scale samples is approximately zero. This, in turn, fills the scale deltas with zeros. Because a 10 element array is used (for example) and the balance is sampled once every tenth of a second, the balance must remain unchanged for only one second for the method to again attempt control.

Figure 8:
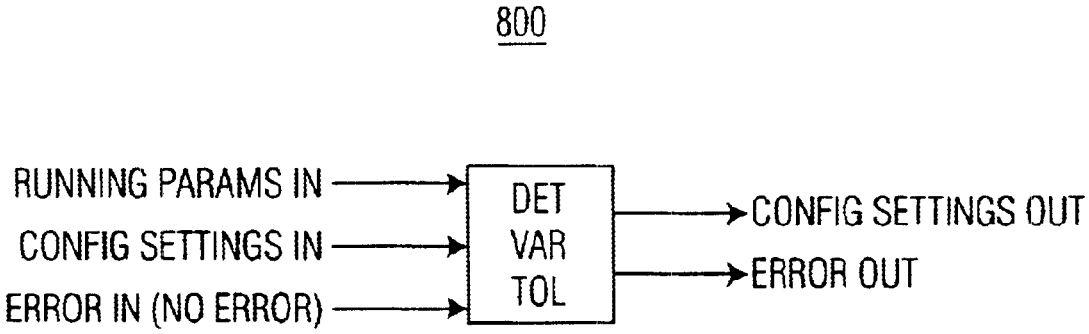
FIGS. 8 and 9 depict an exemplary embodiment of a virtual instrument as it modifies input data to produce output data for determining a mix tolerance and a control current adjustment for controlling the adjustable control valve in the system of FIG. 1, and in accordance with an embodiment of the invention.

Having described the Badger routine, the manner in which the "mA adjustment" numeric and a "Mix Tolerance Divisor" numeric is determined (see configuration settings in Table 1 for definition) will be described next. Both numerics are determined by the "determine variable tolerance" routine 800 shown in FIG. 8. The input and output data clusters of the "determine variable tolerance" routine is schematically shown in FIG. 8. A state diagram of this routine, generally designated as 900, is shown in FIG. 9.

Figure 9:
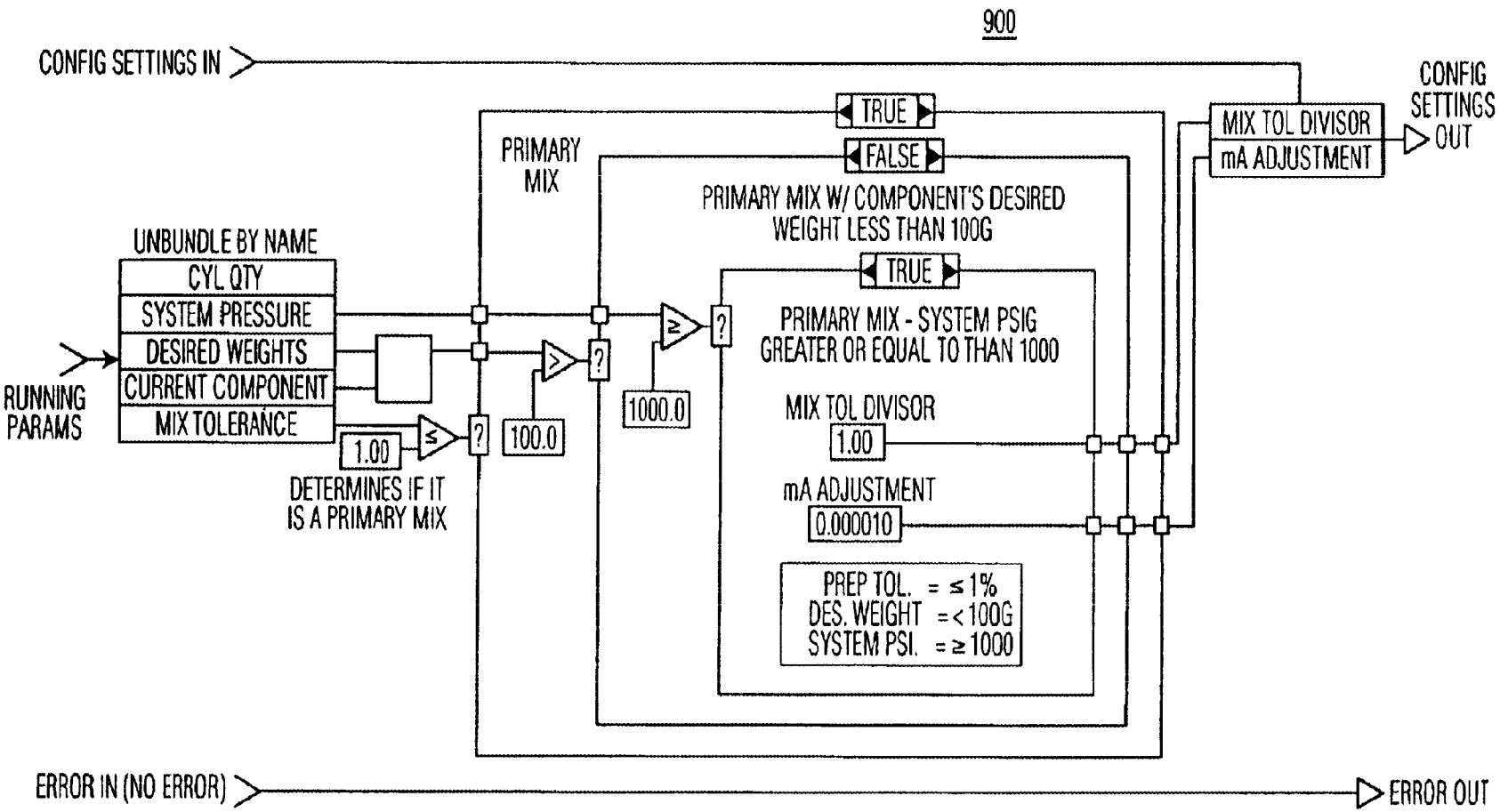

As shown in FIG. 9, routine 900 uses the following information from the "running parameters in" cluster: cylinder quantity, system pressure, desired weights, current component and mix tolerance. These are defined in Table 1. Routine 900 establishes the Mix Tolerance Divisor and the mAmp adjustment based on the required tolerance, the desired weight of the gas component and the system pressure (which is the current pressure of the gas component).

Fine adjustments are made to the Mix Tolerance Divisor and mAmp adjustment when dealing with primary mixes. When the mix is a Certified Standard (mix tolerance greater than 1) the Mix Tolerance Divisor and the mAmp adjustment are set to default value of 2.0 and 0.00010 mAmp, respectively.

A primary mixture requires sharper guidelines to adjust flow rate. When the desired weight is greater than 100 g, the Mix Tolerance Divisor is set to 3 and the mAmp adjustment to 0.000010. These settings are derived from experience and establish a tolerance zone so that when the actual weight is within this zone there is no doubt that the value is "good". It is a safety net.

If a primary mixture's component includes a desired weight that is less than 100 g, the system pressure is taken into account to correctly adjust the Mix Tolerance Divisor and mAmp Adjustment. It is not possible to assign a single default value for mAmp adjustment and Mix Tolerance Divisor. By taking into account variables, such as system pressure, the routine more closely reflects the actual system and its resulting gas flow dynamics. When the system pressure is less than 1000 psig, the Mix Tolerance Divisor is set to 1.5 and the mAmp Adjustment is 0.000010 mAmps. However, when the system pressure is greater than 1000 psig, the Mix Tolerance Divisor is set to 1 and the mAmp Adjustment is 0.000010 mAmps.

The advantage of using the above described "safety net" may be seen in the following example. When requirements of a primary mix tolerance of 1%, a desired weight of 10 grams for the gas, and a system pressure of less than 1000 psig are established, routine 900 uses a Mix Tolerance Divisor of 1.5. If the Mix Tolerance Divisor is not used (e.g. Mix Tolerance Divisor set to 1.00), the actual prepared concentration would be within specification with an actual weight between 9.90 and 10.10 grams (e.g. 1%). On the other hand, if the Mix Tolerance Divisor is set to 1.50, the actual prepared concentration would be within specification with an actual weight between 9.93 and 10.07 grams. In this case, a safety net is extended to the upper and lower bounds of the range. The tolerance of the latter case is more tight than the tolerance of the former case.

It will be appreciated that a tighter safety net may be set by using a divisor that has a value larger than 1.5, for example 3.0. A divisor of 3.0 extends the safety net to require producing a mixture between 9.97 and 10.03 grams. Due to excellent control of the system, a mixture may be produced with a very tight tolerance much better than 1%.

Figure 10:
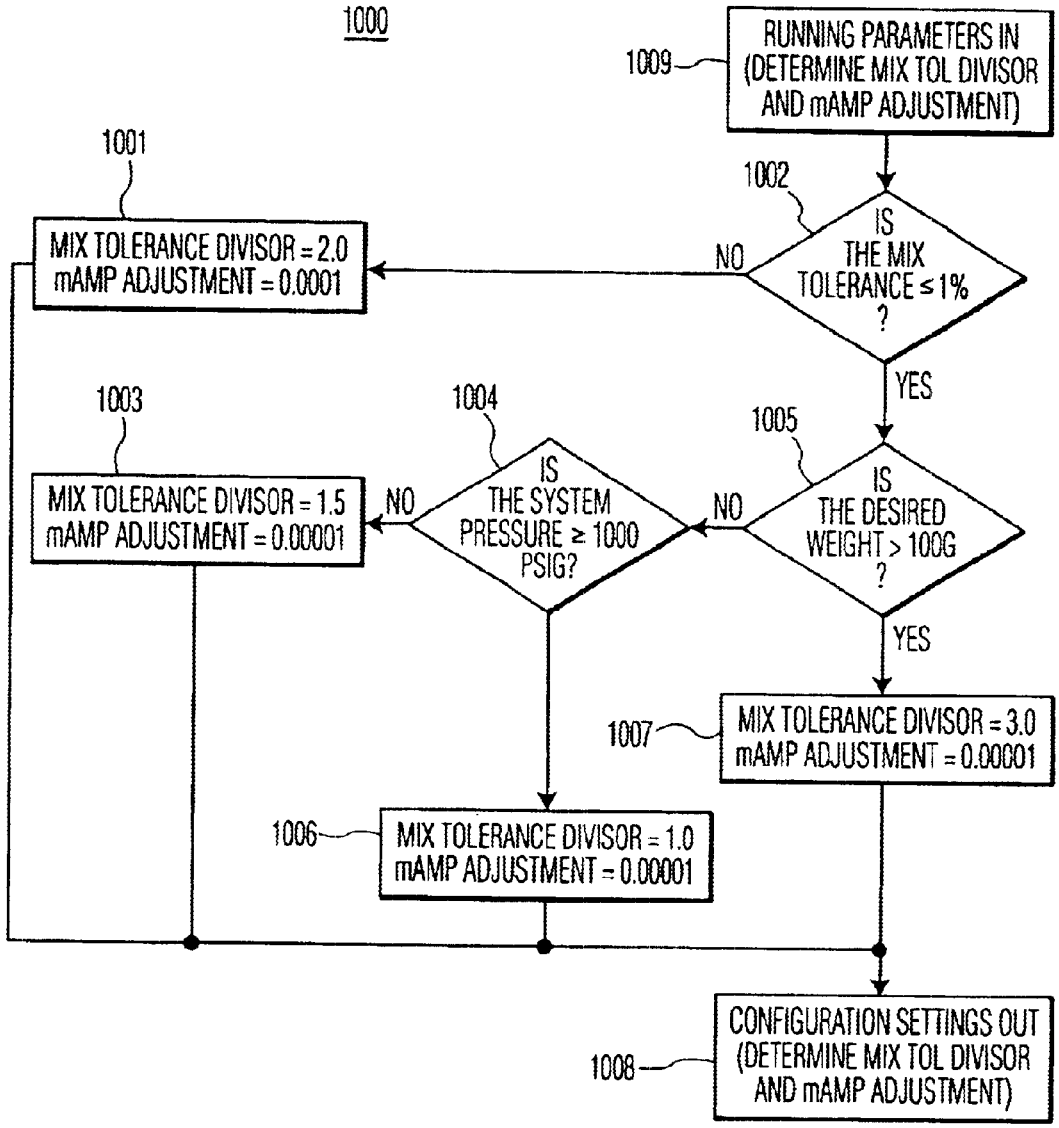
FIG. 10 is a flow diagram depicting a method for determining the mix tolerance and the control current adjustment as performed by the virtual instrument shown in FIGS. 8 and 9, and in accordance with an embodiment of the invention.

The operation of "determine variable tolerance" routine 900 is shown as a flow diagram in FIG. 10 and is generally designated with the numeral 1000. As shown, starting with the Mix Tolerance Divisor and mA Adjustment stored in the "running parameters in" cluster, step 1009 sequences to decision box 1002. Decision box 1002 determines whether the mix tolerance set by the user (per specification) is less than or equal to 1%. If false, decision box 1002 branches to step 1001 and sets the Mix Tolerance Divisor to 2.0 and the mAmp Adjustment to 0.0001. If true, decision box 1002 branches to decision box 1005 to determine if the desired weight of the component gas is greater than 100 grams. If desired weight is greater than 100 grams, step 1007 is entered, and the Mix Tolerance Divisor is set to 3.0 and the mAmp Adjustment is set to 0.00001. If desired weight is less than or equal to 100 grams, decision box 1004 is entered to determine the system pressure setting. If system pressure is greater than or equal to 1000 psig, step 1006 is performed. Otherwise, step 1003 is performed. Step 1006 sets the divisor to 1.0 and the mAmp Adjustment to 0.00001. Step 1003, on the other hand, sets the divisor to 1.5 and the mAmp Adjustment to 0.00001. These two parameters are stored in the "configuration settings out" cluster in step 1008.

Figure 11:
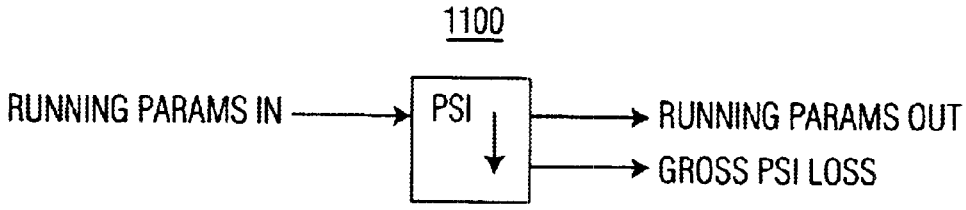
FIGS. 11 and 12 depict an exemplary embodiment of a virtual instrument as it determines whether a leak exists in the system of FIG. 1, in accordance with an embodiment of the invention.
Figure 12:
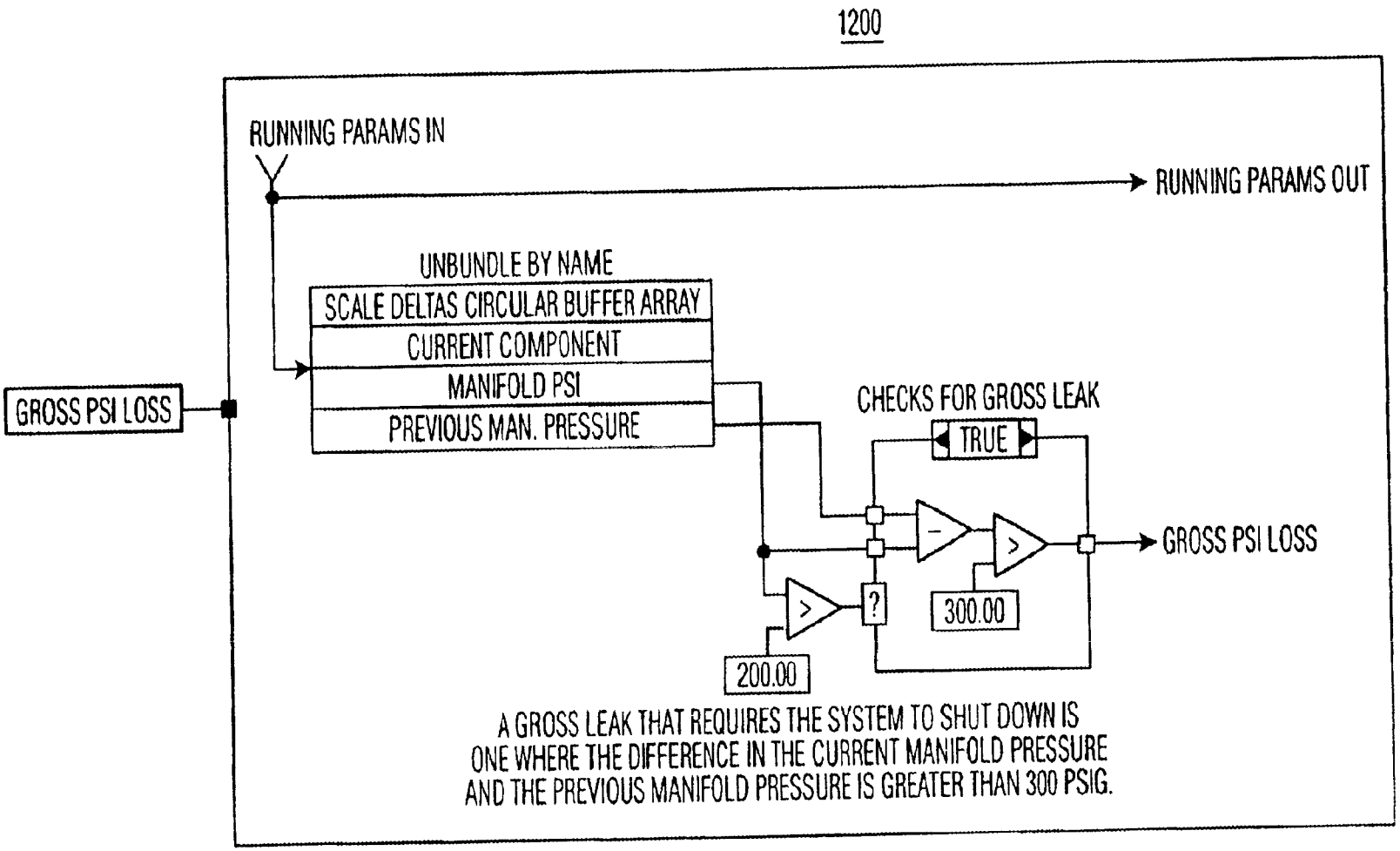

One factor resulting in an emergency shutdown, shown in FIG. 2*a* (step 60), occurs when a gross leak is detected in the system. A gross leak is defined as a change in manifold pressure greater than 300 psig. A gross leak is detected by routine 1100 shown in FIG. 11. A state diagram of routine 1100, generally designated with the numeral 1200, is illustrated in FIG. 12. The information used by the routine from the "running parameters in" cluster is also shown. The output of the routine is a boolean value indicating that a change in manifold pressure greater than 300 psig has occurred (true) or has not occurred (false). The routine also detects a gross leak occurring from a stuck valve.

Figure 13:
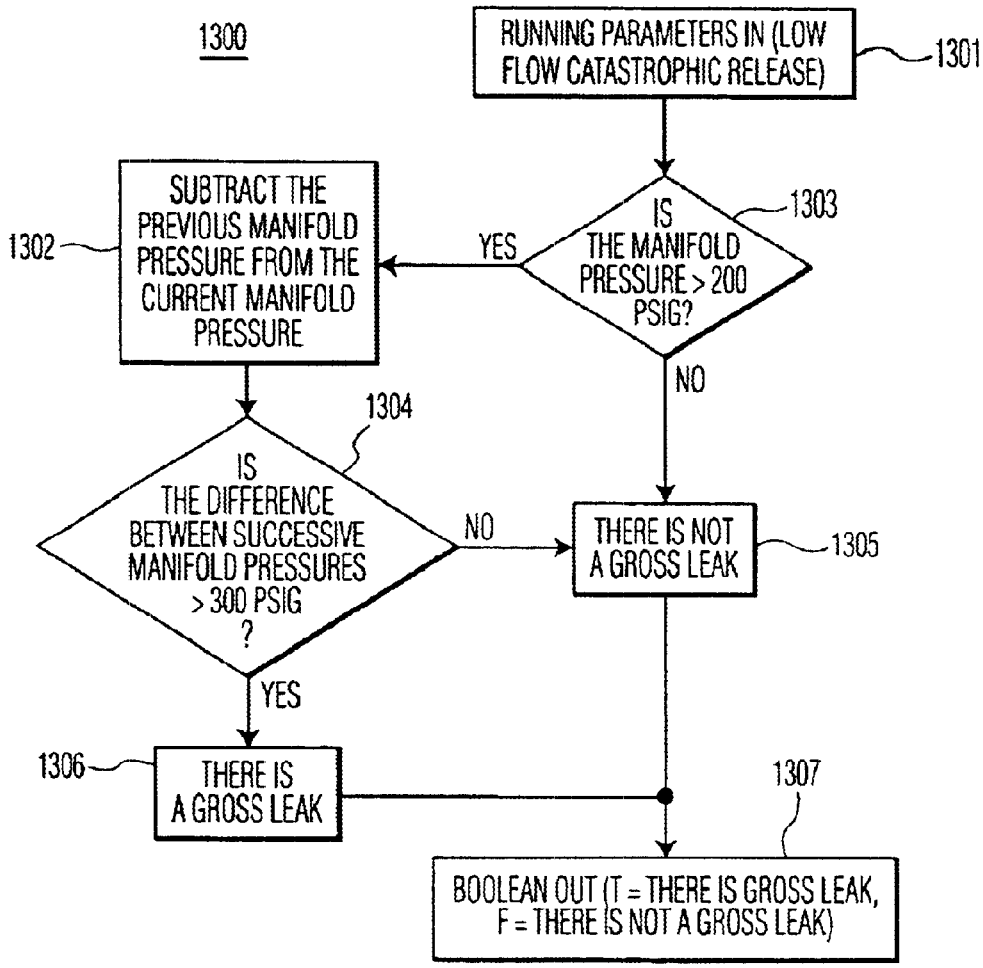
FIG. 13 is a flow diagram depicting a method for determining whether a leak exists as performed by the virtual instrument shown in FIGS. 11 and 12, and in accordance with an embodiment of the invention.

FIG. 13 shows a flow diagram of gross leak routine 1100, and is generally designated as 1300. As shown, between input step 1301 and output step 1307, decision box 1303 is entered. Decision box 1303 determines whether the manifold pressure is greater than 200 psig. If false, step 1305 decides that there is no leak. If true, step 1302 subtracts the previous manifold pressure from the current manifold pressure. Next, decision box 1304 determines if the difference in successive manifold pressures is greater than 300 psig. If the difference is greater than 300 psig, step 1306 decides that a gross leak has occurred.

Figure 14:
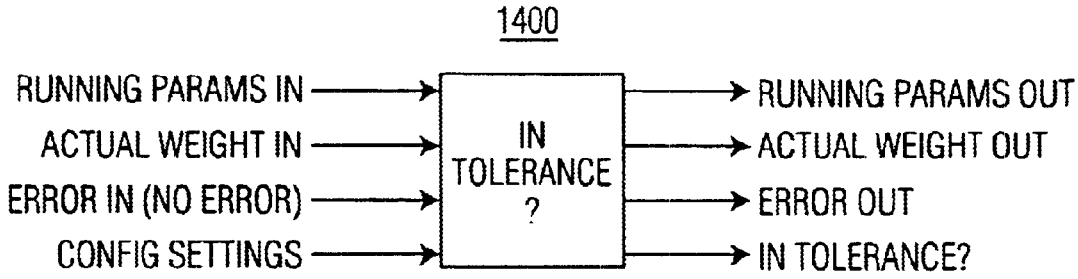
FIGS. 14 and 15 depict an exemplary embodiment of a virtual instrument as it determines whether a mixture is in-tolerance or out-of-tolerance, as gas is being filled into a cylinder, in accordance with an embodiment of the invention.
Figure 15:
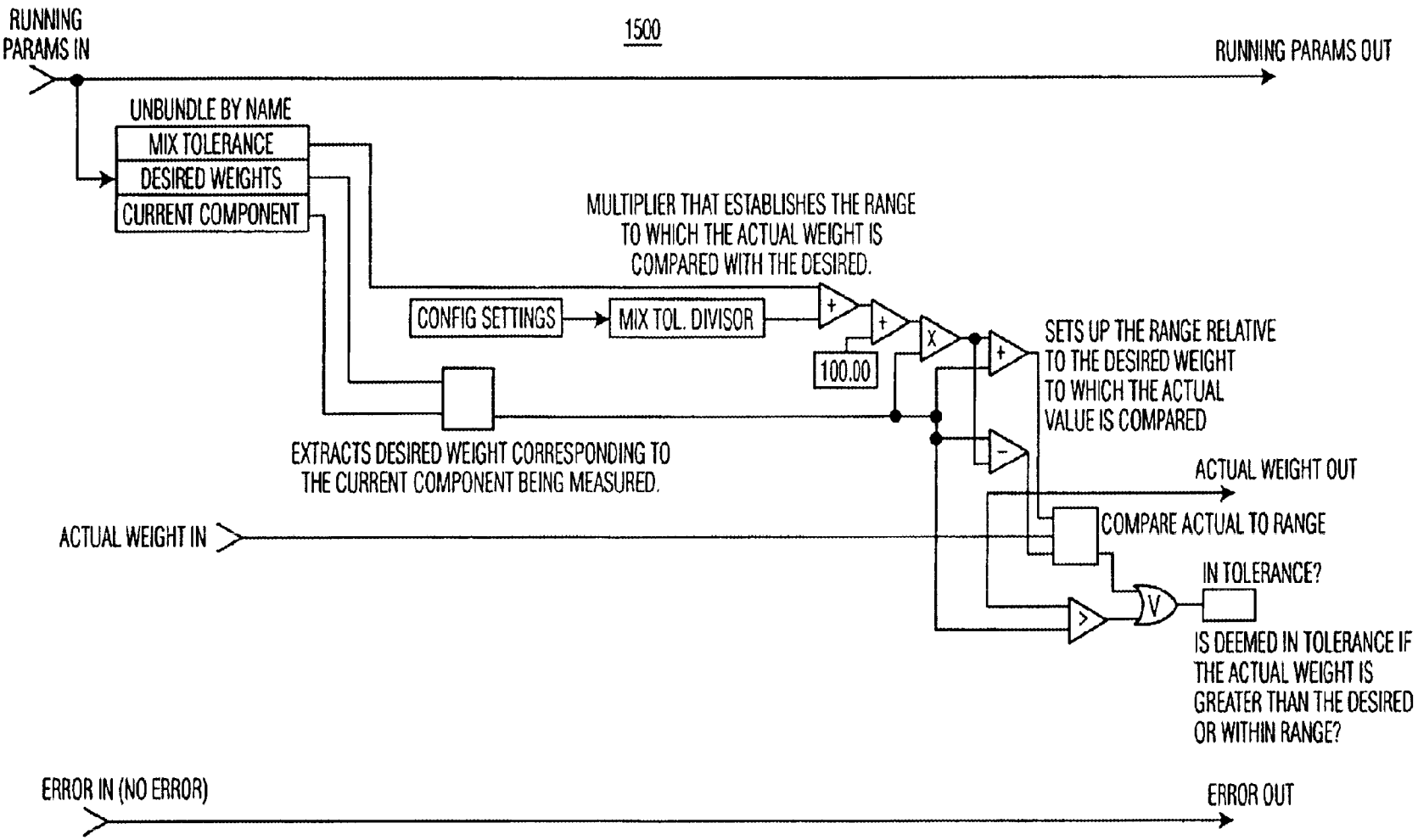

FIG. 14 shows in-tolerance routine 1400 which determines if a mixture is in-tolerance or out-of-tolerance (see FIG. 2*g*, blocks 182 and 183). A state diagram of routine 1400 is shown in FIG. 15, generally designated with the numeral 1500. As shown, the following information is used by the routine as an input: mix tolerance, desired weights, current component, Mix Tolerance Divisor and actual weight IN.

Figure 16:
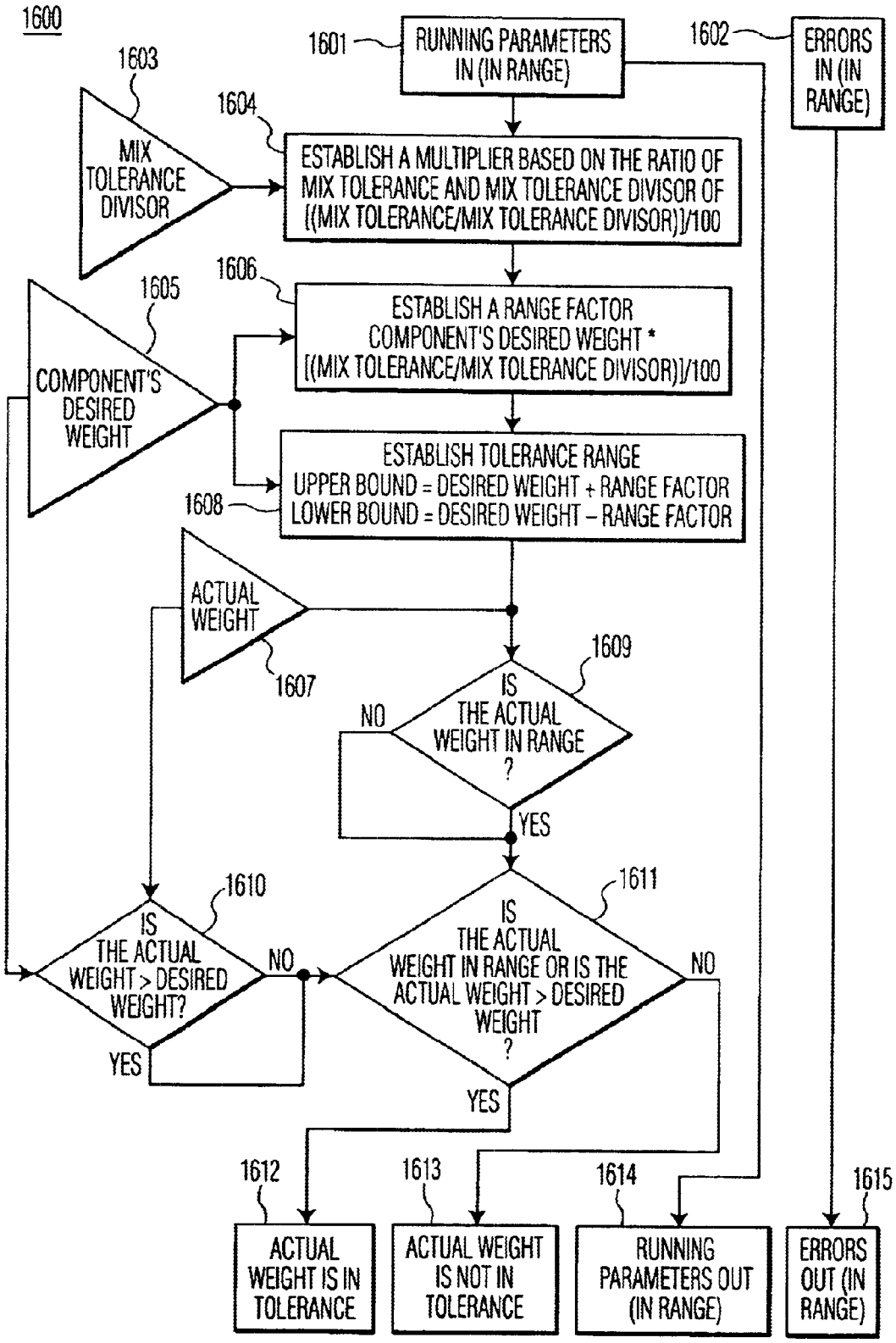
FIG. 16 is a flow diagram depicting a method for determining whether a mixture is in-tolerance or out-of-tolerance as performed by the virtual instrument shown in FIGS. 14 and 15, and in accordance with an embodiment of the invention.

FIG. 16 depicts a flow diagram of the in-tolerance routine, generally designated by the numeral 1600. Operation starts with inputting the running parameters in step 1601, including the Mix Tolerance Divisor (step 1603), the component's desired weight (step 1605) and actual weight IN (step 1607). Step 1604 establishes a multiplier based on the ratio of the mix tolerance required by the user and the Mix Tolerance Divisor. A range factor is established with the formula shown in step 1606. Subsequently, step 1608 establishes the tolerance range using the two equations shown in the box.

Decision boxes 1609, 1610 and 1611 determine whether the actual weight is in range and whether the actual weight is greater than the desired weight. Step 1612 or 1613 is entered depending on whether the actual weight is in-tolerance or the actual weight is out-of-tolerance, respectively. Finally, step 1614 updates the running parameters and step 1615 provides an appropriate indication to the user.

Figure 17:
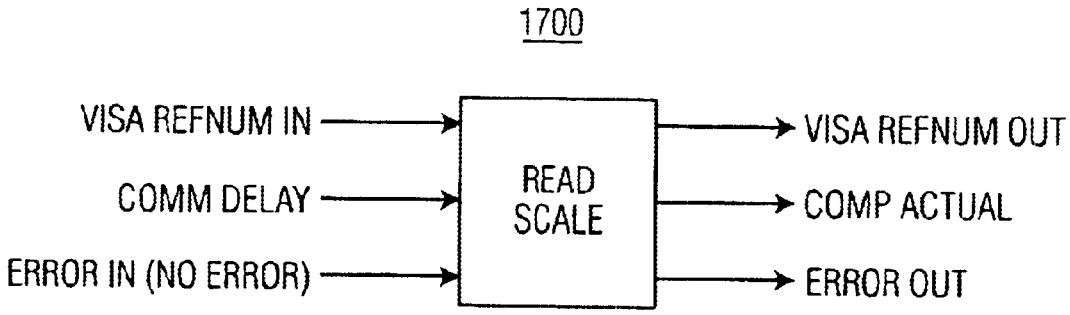
FIGS. 17 and 18 depict an exemplary embodiment of a virtual instrument as it reads actual weight from a scale in the system of FIG. 1, in accordance with an embodiment of the invention.

FIG. 17 shows read scale routine 1700, which communicates with a scale measuring the weight of a cylinder being filled with a gas component. It will be appreciated that a scale may measure the weight of a single cylinder or multiple cylinders. The scale may be a Mettler balance, for example. Communications between the Mettler balance and processor 34 is bidirectional. Commands are sent from processor 34 to control the Mettler balance and weight measurements are sent from the Mettler balance to the processor. Communications between the processor and the Mettler balance may be direct, thereby eliminating a need for signal conditioning or buffering.

Figure 18:
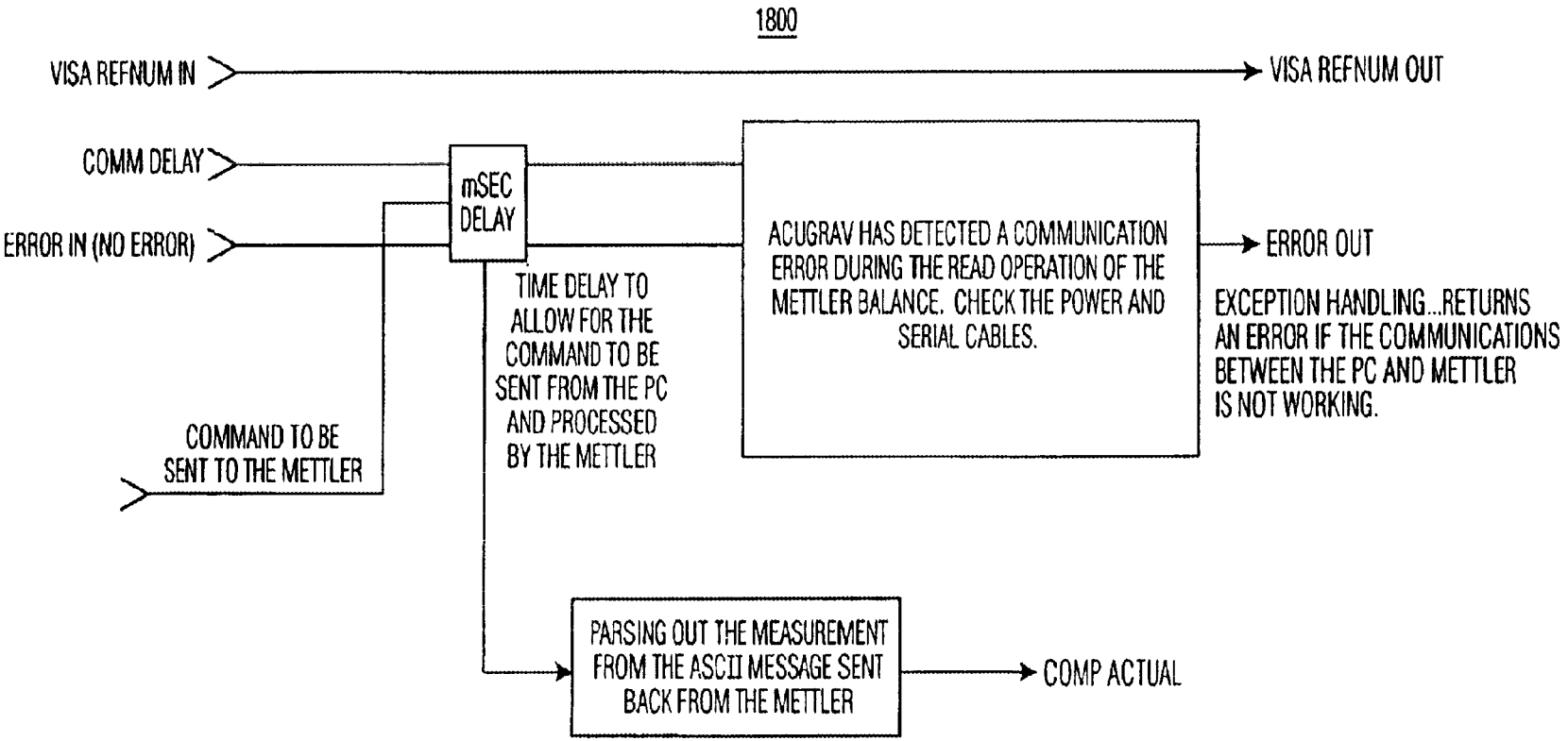

A state diagram of routine 1700 is shown in FIG. 18, generally designated with the numeral 1800. As shown, the following information is used by the routine as an input: Virtual Instrument Reference Number In (VISA Reference In), communications delay and error in. The following information is output by the routine: VISA Reference Out, error out and component actual weight.

Figure 19:
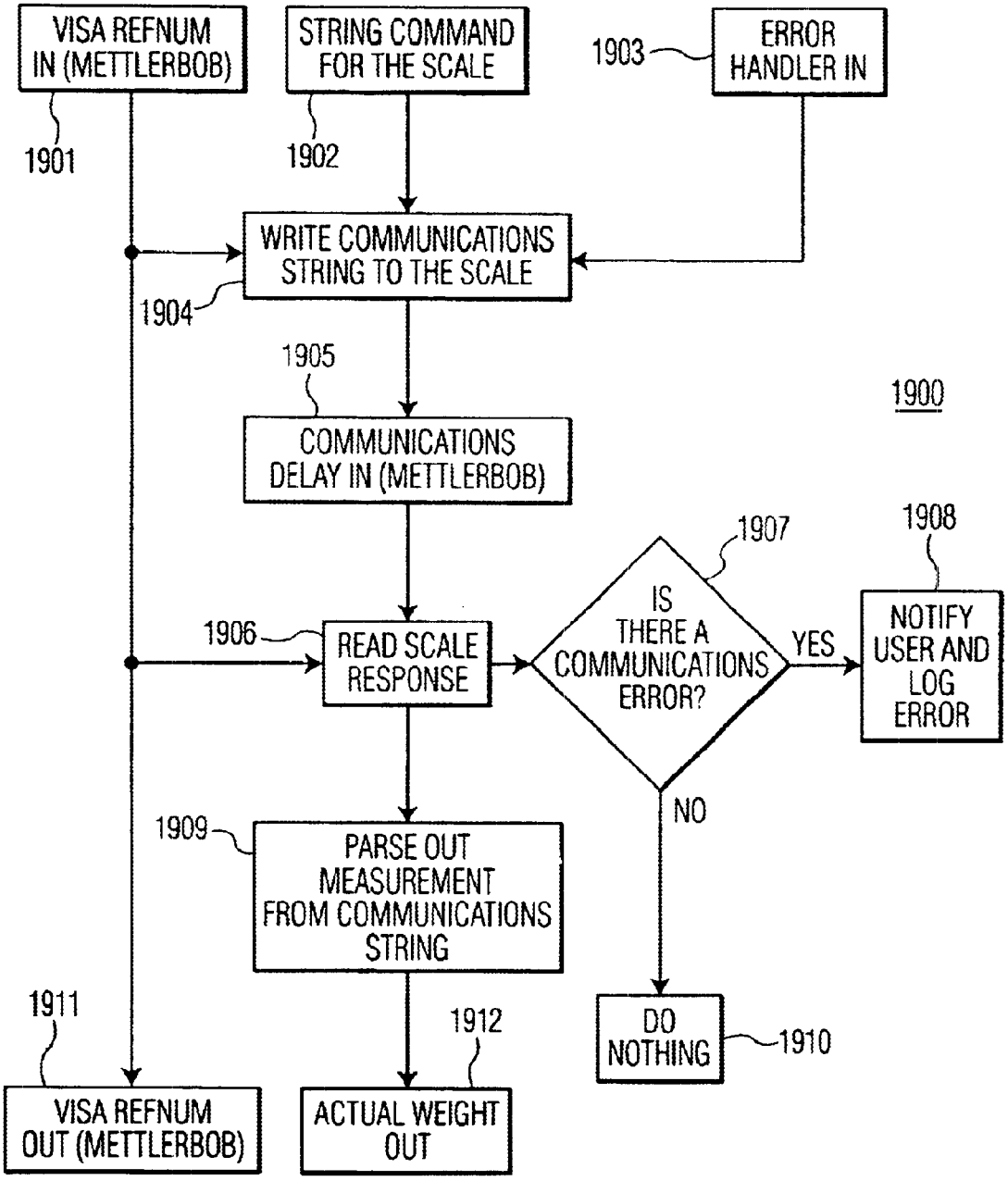
FIG. 19 is a flow diagram depicting a method for reading actual weight from a scale as performed by the virtual instrument shown in FIGS. 17 and 18, and in accordance with an embodiment of the invention.

FIG. 19 depicts a flow diagram of the read scale routine, generally designated with the numeral 1900. As shown, a string command is sent from the processor to the scale (steps 1902 and 1904). A predetermined time delay is provided (for example, 25 msec) to allow for the command to be sent to the scale from the processor and be processed by the scale (step 1905). The routine then reads the scale response (step 1906) and parses out the weight measurements (steps 1909 and 1912).

Communication errors are handled by error handler in (step 1903) and modified by error handler out (step 1908). If no communication errors are detected in step 1907, modifications are not made to the error handling routine (step 1910). Each string command sent to the scale is identified and tagged by VISA Reference In and VISA Reference Out (steps 1901 and 1911).

Figure 20:
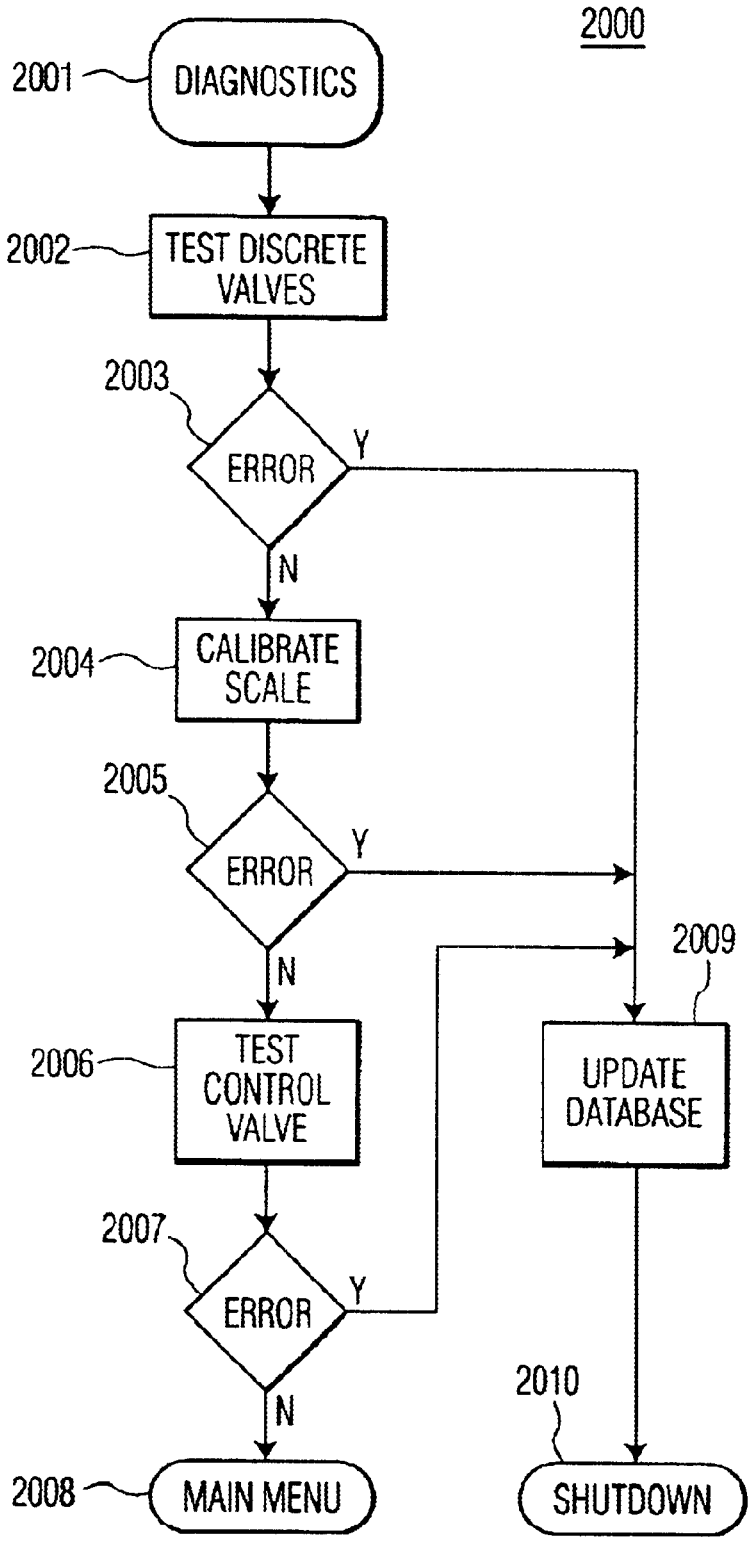
FIG. 20 is a flow diagram depicting a method of calibrating and diagnosing the operational status of the system shown in FIG. 1 in accordance with an embodiment of the invention.

Turning next to various diagnostic routines executed by the processor, there is shown diagnostic method 2000 in FIG. 20. As shown, the method enters the diagnostic mode in step 2001. The discrete valves (five system valves and eight component valves, as listed in Table 1) are individually tested in step 2002. The physical state of each valve is monitored and compared to program logic (explained below). If the state of a valve disagrees with the program logic, decision box 2003 determines that an error has occurred. The method enters step 2009 and updates the database to store the status of the discrete valves. The system is shutdown in step 2010.

If decision box 2003 determines that an error has not occurred, the method enters step 2004 and calibrates the scale (explained below). Decision box 2005 is entered next. If the calibration indicates that the scale is not in tolerance, the method loops to step 2009 and updates the database. The system is shutdown in step 2010. If decision box 2005 determines that the scale is within tolerance, step 2006 is entered and the control valve (valve 28 in FIG. 1) is tested. As will be explained, the method applies different current values (4–20 mA, for example) to the control valve. Each current value causes the control valve to more fully open or more fully close from its previous state. The method monitors a set of respective switches that indicate if the control valve has physically moved through its dynamic range. If an error is detected in decision box 2007, the method loops to step 2009 and updates the database. The system shuts down in step 2010. If an error is not detected, however, the method permits operation to continue by branching back to the main menu in step 2008.

It will be appreciated that although FIG. 20 shows that the discrete valves, the scale and control valve are sequentially tested, in another embodiment each may be tested in a different sequence or each may be individually tested. For example, the user may program the processor to execute scale calibration (step 2004) or control valve test (step 2006) at different times (for example, once per week).

Figure 21:
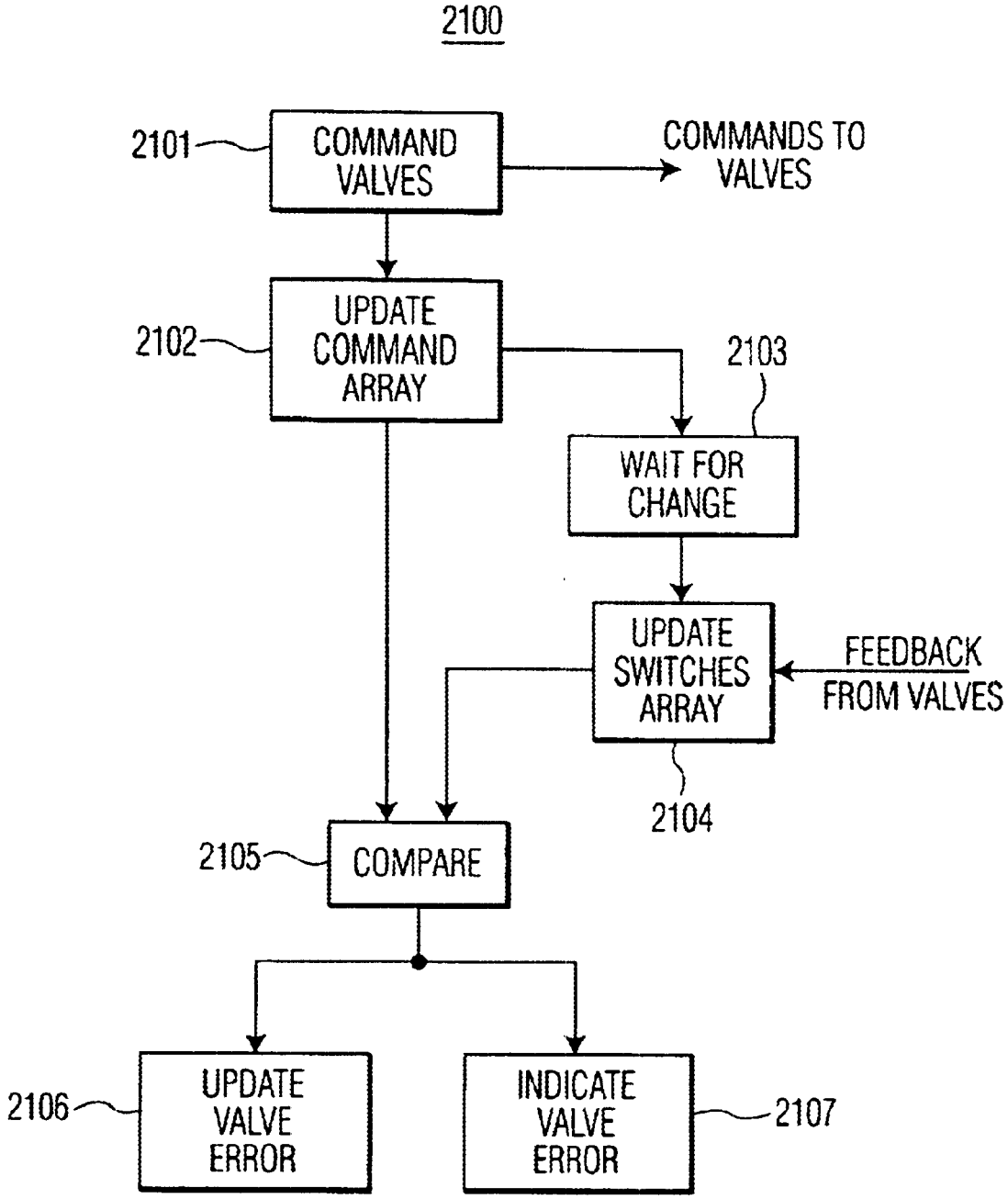
FIG. 21 is a flow diagram depicting a method of testing the operational status of multiple system valves and component valves of the system shown in FIG. 1 in accordance with an embodiment of the invention.

A discrete valve test method is shown in FIG. 21 and is generally designated as 2100. The method monitors the physical state of each valve and compares it to the program logic. The physical state of each valve is monitored via a respective switch mounted to the valve that responds to physical movements of the valve. The method enters step 2101 and commands the system and component valves to open or close. As listed in Table 1, there are 5 system valves and 8 component valves. The commands to each valve may be sent sequentially (one valve command after another valve command) or concurrently (commands generated to all valves in substantially the same time). Step 2102 updates the command arrays in response to the commands sent to the valves. The system valves array may be a 5-element Boolean array and the component valves array may be an 8-element Boolean array. As a command is sent to a valve, the array is updated.

The method waits a predetermined time to allow each valve to change state (step 2103). The method monitors the feedback from each switch and updates two system valve arrays and two component valve arrays. These arrays are a normally-open (NO) array and a normally-closed (NC) array for the system valves; and a NO array and a NC array for the component valves (step 2104). The command arrays (system and component command arrays) are continuously compared to the feedback states stored in the switches (system and component valve arrays (step 2105). If the states of the switches stored in the arrays do not match the command arrays, the method updates the error cluster (step 2106) and may shut down the system. The method may also provide a valve error indicator to the display and may identify a failed system valve or a component valve (step 2107).

Figure 22:
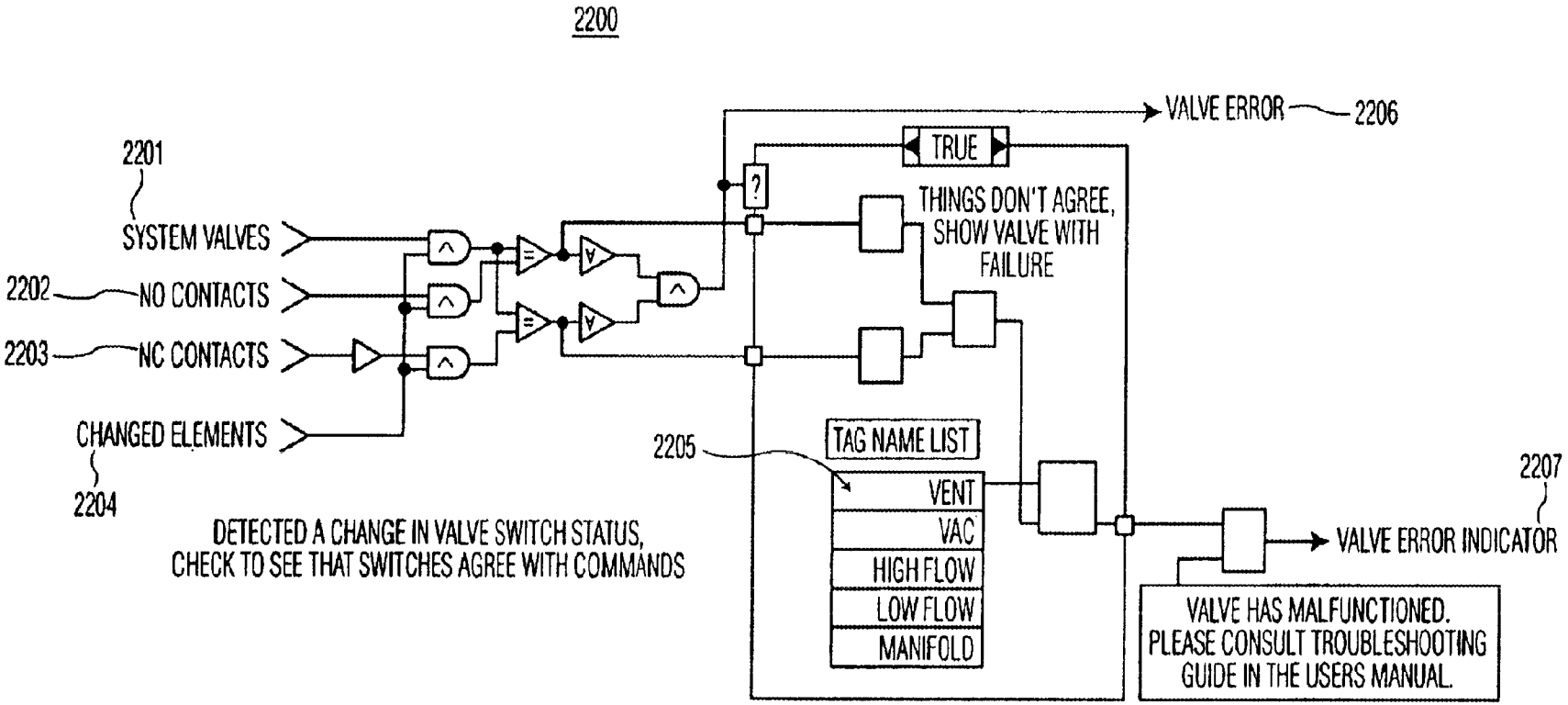
FIG. 22 illustrates a virtual instrument for checking the operational status of multiple system valves in the gas cylinder filling system shown in FIG. 1, in accordance with an embodiment of the invention.

FIG. 22 illustrates a check system valves virtual instrument (VI) diagram, designated as 2200. As shown, system valves array 2201 is logically compared to NO contacts array 2202 and NC contacts array 2203. Changed elements Boolean 2204 stores an indication that the logic has detected a change in the valve switch status. If the system valves array does not agree with either the NO contacts array or the NC contacts array, the VI provides valve error Boolean 2206 to the error cluster. The logic of the VI tags a name to the system valve error. The names of the system valves are stored in table 2205. The name of the malfunctioned system valve is provided to the display via valve error indicator 2207.

Figure 23:
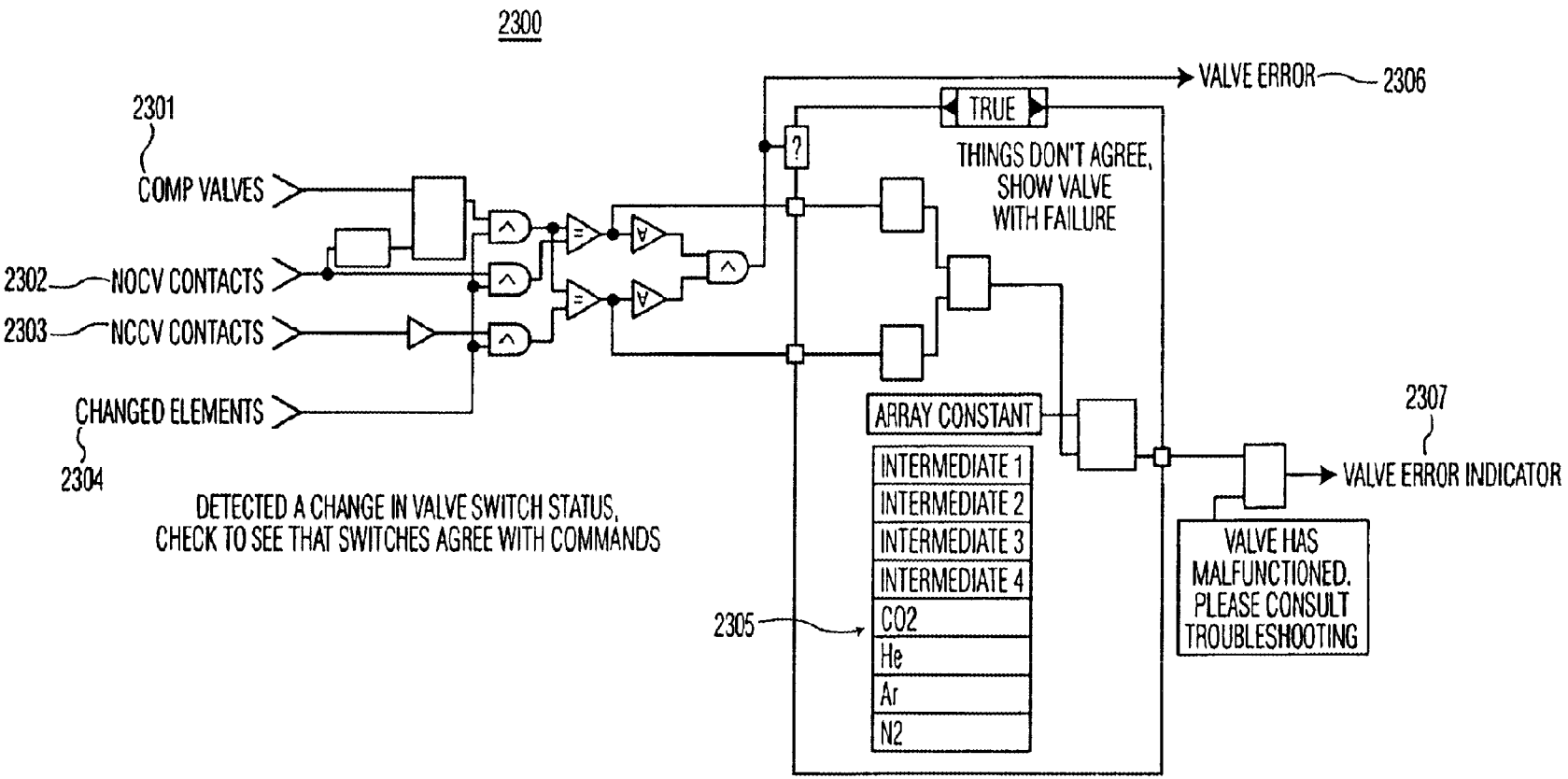
FIG. 23 illustrates a virtual instrument for checking the operational status of multiple component valves in the gas cylinder filling system shown in FIG. 1, in accordance with an embodiment of the invention.

Similar to the check system valves VI, FIG. 23 illustrates a check component valves VI diagram, designated as 2300. As shown, component valves array 2301 is logically compared to NO component valves contacts array 2302 and NC component valves contacts array 2303. Changed elements Boolean 2304 stores an indication that the logic has detected a change in the valve switch status. Detection of a change enables the AND-gates of the logic. If the component valves array does not agree with either the NO contacts array or the NC contacts array, the VI provides valve error Boolean 2306 to the error cluster and the name of the component valve that has malfunctioned via valve error indicator 2307.

Figure 24:
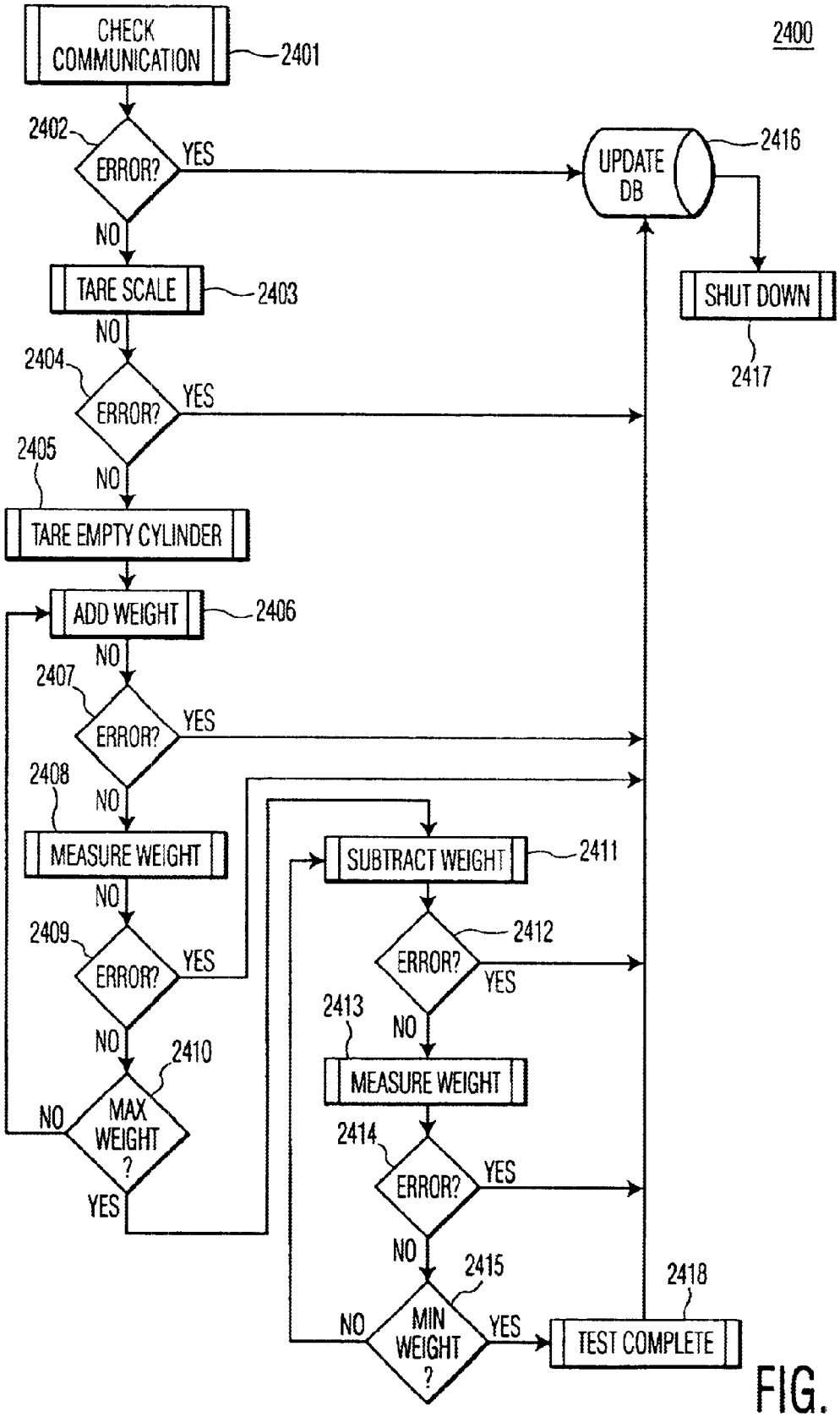
FIG. 24 is a flow diagram depicting a method of calibrating a scale used for measuring weight of a cylinder in the system shown in FIG. 1, in accordance with an embodiment of the invention.

FIG. 24 illustrates a method for performing scale calibration, designated as 2400. The method begins in step 2401 and checks communications between processor 34 and weight scales 40*a*–40*c* (FIG. 1). If an error is detected in step 2402, the method branches to step 2416 and updates the database (error cluster). The system is shut down in step 2417.

If an error is not detected, the method branches to step 2403 and prompts the user, through a dialog screen on the display to zero the weight of the scale (tare weight). If the weight of the scale is correctly zeroed, as determined by decision box 2404, the method prompts the user to zero the weight of an empty cylinder (step 2405). An appropriate weight is added to the scale (step 2406). Another dialog screen prompts the user to measure the weight on the scale (step 2408). The method continues to prompt the user to add more weight until a maximum weight is reached (step 2410).

If the maximum weight has been reached, the method begins to prompt the user to subtract weight from the scale (step 2411). The user is prompted to measure the weight on the scale (step 2413). The method continues to prompt the user to subtract weight until a minimum weight is reached (step 2415). The method may detect an error during the calibration process at each of decision boxes 2407, 2409, 2412 and 2414. Any detected error during calibration may cause the method to update the database (error cluster) and then shut down the system.

It will be appreciated that each scale in the system may be sequentially calibrated, one at a time, or concurrently calibrated at substantially the same time by adding or subtracting the same weights from each scale. The method prompts the user to serially add specific weights and serially subtract specific weights. The method compares the measured weights read by the scale with the expected weights stored in the database. If the measured weights and the expected weights are not within a tolerance of 1 gram, the method determines that the scale is out of calibration and may shut down the system.

Figure 25:
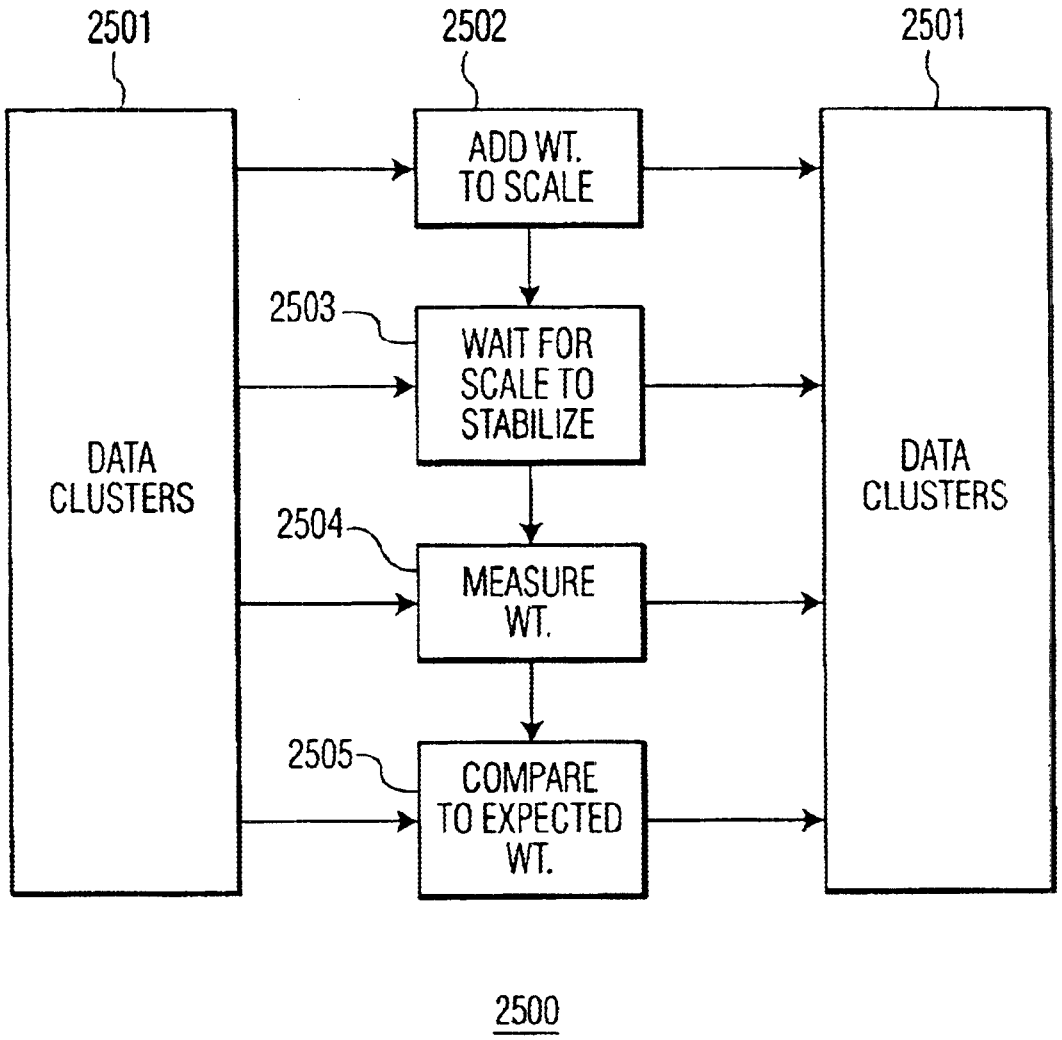
FIG. 25 is a flow diagram depicting a method of scale calibration illustrated as a graphical virtual instrument routine, in accordance with an embodiment of the invention.

FIG. 25 illustrates a scale calibration method as a graphical VI routine, generally designated 2500. Step 2502 prompts the user to add weight to the scale. The amount of weight to be added is stored in the running parameters cluster of data clusters 2501. For example, a desired weight may be stored as an element in a desired weight array. Step 2502 prompts the user to add the desired weight obtained from the data cluster.

After the desired weight is added by the user, step 2503 waits for the scale to stabilize. A timer may be started and step 2503 may then wait until a sufficient time interval passes (for example 5 seconds), so that the scale is stabilized. After the timeout, step 2504 reads the weight on the scale and reports the actual weight via the communications path to the processor. The actual weight read by the scale is stored as an element in an actual weight array in data clusters 2501. The desired weight stored in the desired weight array is compared to the actual weight stored in the actual weight array (step 2505).

In this manner, the method uses the data stored in the data clusters as input values to determine a succession of weights to add to the scale (or multiple scales), and a succession of weights to subtract from the scale (not shown). The method uses timeout data stored in the data clusters to determine a waiting interval before reading the scale. The method uses the configuration setting cluster to determine an amount of increase (or decrease) of weight on a scale. The method also uses the error cluster to report and store errors. As data is updated (for example, weight pointers, cumulative weights, error tolerance, timer count), the elements in the data cluster arrays are also updated.

Figure 26:
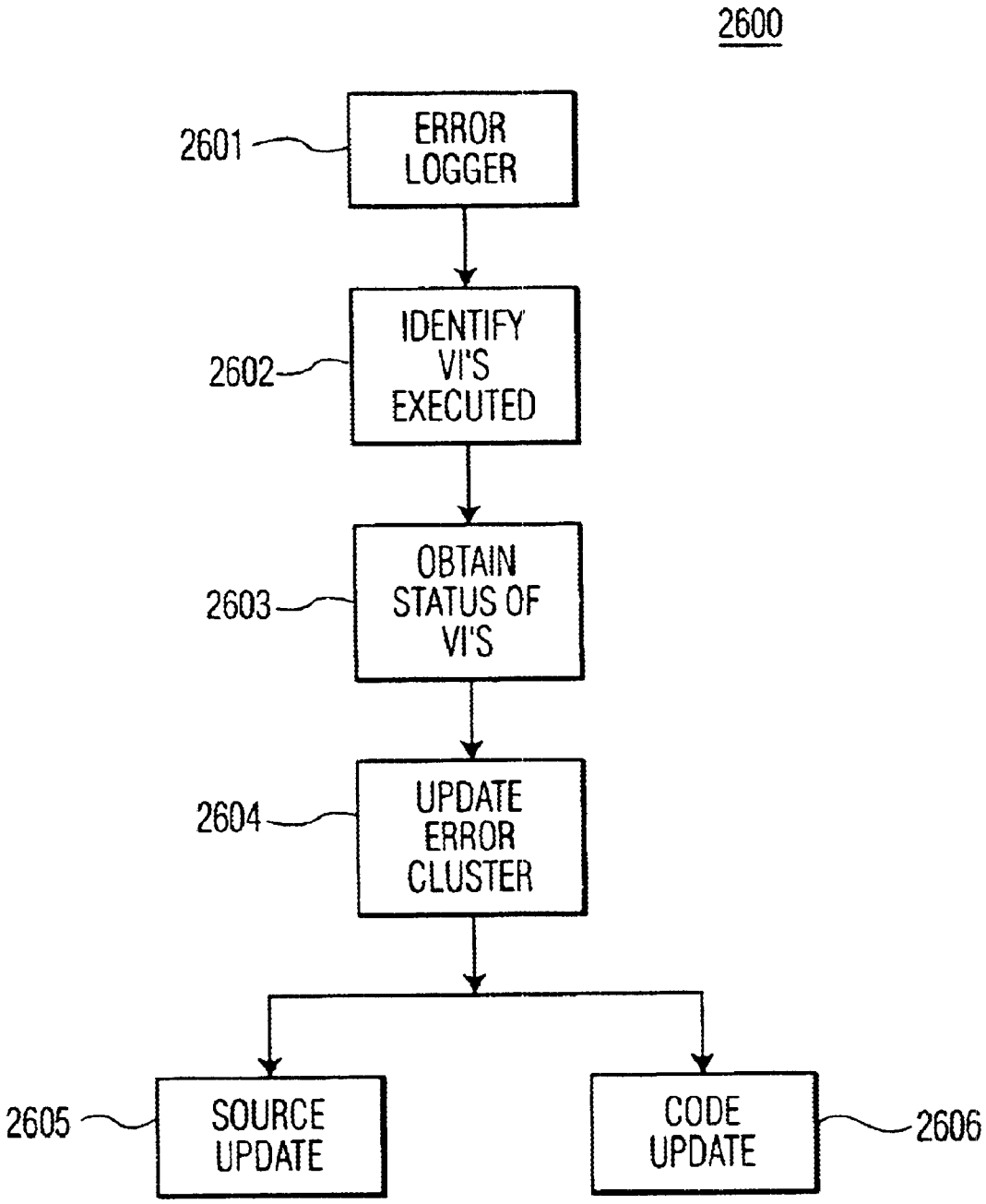
FIG. 26 is a flow diagram depicting a method of logging errors in a data cluster of the system of FIG. 1 during operation, in accordance with an embodiment of the invention.

FIG. 26 illustrates a method for logging errors, which may have occurred in program routines executed by the processor. The error logger method begins at step 2601. Program routines which have executed, such as control valve test virtual instrument (VI), valve actuation test VI, and scale calibration VI, are identified in step 2602. The status (a Boolean indicating error or no error) of each executed VI is obtained in step 2603. The error logger routine accepts the status information from these VIs and updates the error cluster in step 2604. A source string is updated in step 2605, which may describe the origin of the error and may provide a warning to the user. A code string is updated in step 2606, which describes and gives more information about the error. A pop-up option may also be displayed to visually provide an explanation of the error to the user.

Figure 27:
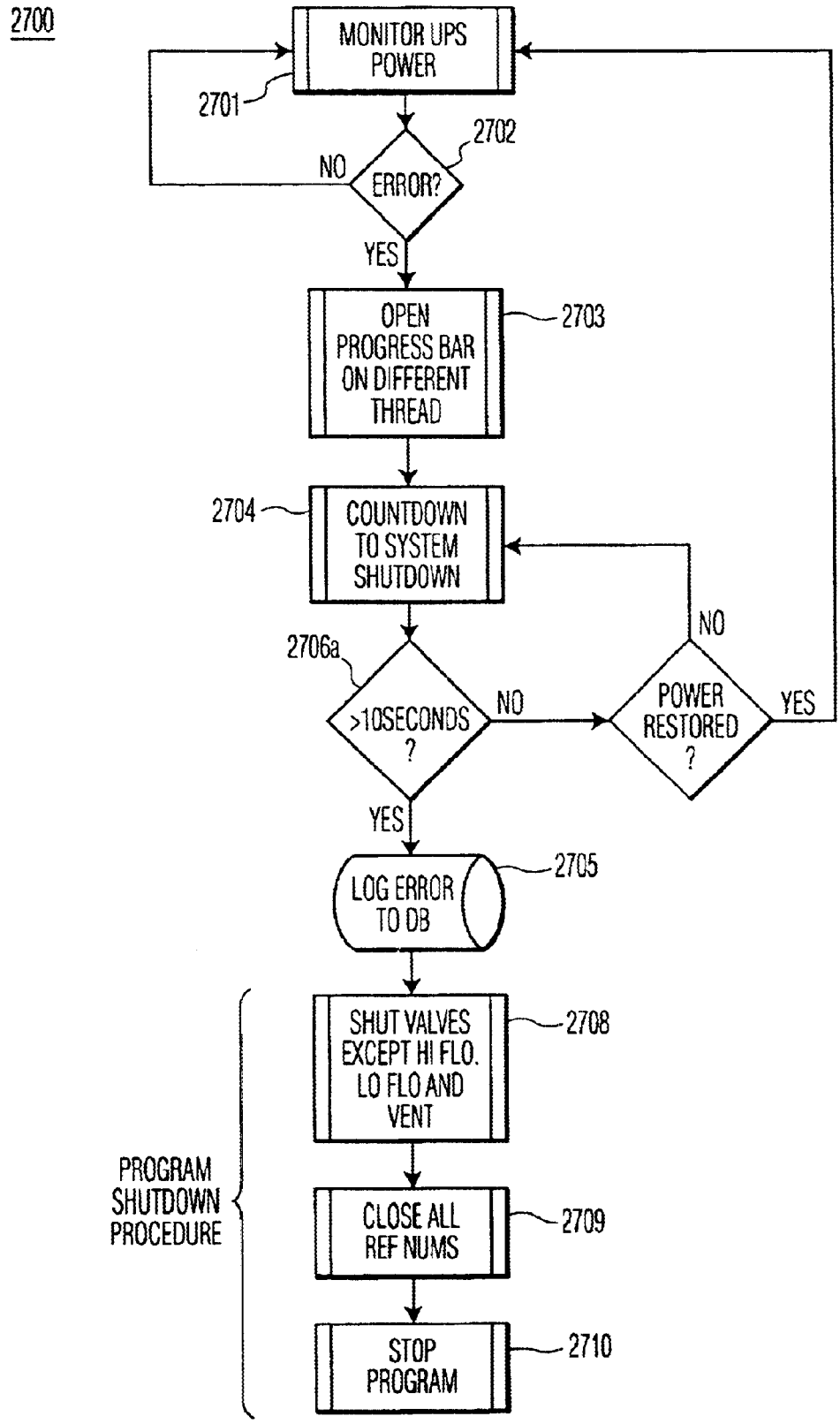
FIG. 27 is a flow diagram depicting a method of responding to a power interruption during operation, in accordance with an embodiment of the invention.

A method of responding to primary power interruption is shown in FIG. 27 and is generally designated as 2700. The method monitors the status of the universal power supply (UPS), which is a back-up power supply (step 2701). If an error is detected by step 2702 (for example, back-up supply is below a predetermined voltage level), the method enters step 2703. A UPS timer subroutine begins to execute on a separate thread in the processor. In this manner, the power status may be monitored without hindering the main program running in the processor.

A countdown to system shut down is started in step 2704. The method continues to check for primary power restoration (step 2706*b*). If primary power is not restored within 10 seconds (step 2706*a*), the method branches to step 2705 and logs the error to a database. All valves, except high flow valve (26*a*), low flow valve (26*b*) and vent valve (24*b*), are closed (step 2708). Reference numbers in the program are closed (step 2709) and the program is stopped (step 2710).

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

TABLE 1

CLUSTERS OF INFORMATION AND DATA USED BY THE PROCESSOR FOR CONTROL AND STATUS INDICATIONS.

Controls and Indicators error in (no error). The error in cluster can accept error information wired from VIs previously called. Use this information to decide if any functionality should be bypassed in the event of errors from other VIs. The pop-up option Explain Error (or Explain Warning) gives more information about the error displayed.

Status. The status boolean is either TRUE (X) for an error, or FALSE (checkmark) for no error or a warning.

The pop-up option Explain Error (or Explain Warning) gives more information about the error displayed.

code. The code input identifies the error or warning.

The pop-up option Explain Error (or Explain Warning) gives more information about the error displayed.

source. The source string describes the origin of the error or warning.

The pop-up option Explain Error (or Explain Warning) gives more information about the error displayed.

Actual Weight IN. This value represents the actual weight measured by the Metler scale representing the weight of the component currently being added.

Config Settings. Ms delay for the main logic loop.

Purge Level. This Pressure Setting compares the manifold pressure to this pre-set value that has been read in from an initialization file or the system defaults and replaces the respective boolean array control with the boolean "answer" to the greater than/equal to comparison.

Vent Level. This pressure setting acts as a comparator in the "Vent Intermediate Lines" state, where the resultant boolean from a greater than or equal to the system pressure, is passed to the boolean valve control array.

Prep Vac Level. This value is a pre-defined parameter read from an initialization file or system defaults that is used as a comparator to the system pressure. Depending on if the system pressure is less than or equal to this value the vacuum valve will be remain closed or open.

TABLE 1-continued

CLUSTERS OF INFORMATION AND DATA USED BY THE PROCESSOR FOR CONTROL AND STATUS INDICATIONS.

Vac Level. This is a pre-defined value through an initialization file or by default that is used in a number of states to compare actual vacuum levels to the pre-defined level. Its main function is to give a pre-defined value to compare against and thus generate a boolean in response. The boolean is subsequently used in a case structure to decide on the best course of action.

Mix Tol Divisor. The Mix Tolerance Divisor is a configuration setting and exists as a double precision numeric. It's default value is either read from an in file or the system defaults. The value of this setting is dependent on the Mix Tolerance, the Desired Weight of a particular component and the system pressure. Given different values for these variables a decision making scheme is employed to adjust this Mix Tolerance Divisor. It is a major variable used in developing the tolerance range to which the Actual Weight is compared in the "In Tolerance". VI Mix Tol Divisor Big Add. This function is not used in this version of software. It will be removed from subsequent versions.

Low Flow Mass. This pre-configured value is used to set the parameter for Low Flow Mass when determining the range used to check the actual value measured from the scale relative to the desired. It is used in conjunction with the Low Flow Tolerance.

Low Flow Tolerance. The Low Flow Tolerance is used to set the tolerance range to which the actual weight of a component is measured against its desired weight. The outcome is a boolean that is used to decide the next appropriate step.

High Precision Range. The High Precision Range is used in determining the range from which an component's actual weight is compared to the desired weight. This value is set to a default 40 g when the component is one of the following gases: CO(2), Ar, N(2).

Low Precision Range. This configuration parameter is used in defining the range to which the actual component weight is compared to the desired component weight. Specifically, it is used when an intermediate is above 1000 PSIG and one is making a primary mix. (Mix Tol <= 1%).

Main Loop. This configuration control provides a pre-defined delay time to be used in the main state machine While Loop. Using a delay aids in data flow by regulating the amount of time a piece of data is read from a certain location. For example, without a delay a value may be read multiple time from the same location increasing the chance of corrupting your data. Delays are used in data acquisition and error loops for the same reasons. (aliasing, etc)

Read Final Weight Delay. This configuration control provides a pre-defined delay time to be used in the main state machine While Loop. Using a delay aids in data flow by regulating the amount of time a piece of data is read from a certain location. For example, without a delay a value may be read multiple time from the same location increasing the chance of corrupting your data. Delays are used in data acquisition and error loops for the same reasons. (aliasing, etc)

Data Acq Main. This configuration control provides a pre-defined delay time to be used in the main state machine While Loop. Using a delay aids in data flow by regulating the amount of time a piece of data is read from a certain location. For example, without a delay a value may be read multiple time from the same location increasing the chance of corrupting your data. Delays are used in data acquisition and error loops for the same reasons. (aliasing, etc)

Error Loop Main. This configuration control provides a pre-defined delay time to be used in the main state machine While Loop. Using a delay aids in data flow by regulating the amount of time a piece of data is read from a certain location. For example, without a delay a value may be read multiple time from the same location increasing the chance of corrupting your data. Delays are used in data acquisition and error loops for the same reasons. (aliasing, etc)

Error Loop CV. This pre-configured control is used in the exception handling state machine to compare against the current error monitoring value for the component valves.

Error Loop SV. This pre-configured control is used in the exception handling state machine to compare against the current error monitoring value for the system valves.

mA adjustment. This double precision numeric control is a variable determined in an external subroutine. Once the value is ported to this variable it serves to determine the mAmp adjustment to be applied.

MT Max Pres. This is a pre-defined pressure, through an initialization file or by default, that is used in comparison to the Manifold TABLE 1-continued CLUSTERS OF INFORMATION AND DATA USED BY THE PROCESSOR FOR CONTROL AND STATUS INDICATIONS.

pressure as a check to see if the attached cylinder(s) have been properly prepared.

Running Params IN. This cluster is composed of 28 data types. The following data types are of use in the subroutine:

Scale Deltas: A 10 element array of the last 10 scale readings.

Actual Weights: 8 element array of the current scale readings

Fill Time. Time it takes to fill the cylinder. Continuously updated as cycle per gases.

Desired Weights. 8 element array for the desired weights relative to the inlet position.

Weights. Element of the Desired Weights Array. There are 8 elements in this array. Each one representing a corresponding intermediate or house gas.

Actual Weights. This is an 8 element array of current scale readings relative to the inlet position.

Weights. Element of Actual Weights Array.

Vac Hi. This double precision floating variable represents the current Hi Vacuum channel reading in Torr System Pressure. Pressure(psig) of system not manifold. Used to take pressure readings that do not require the manifold valve to be open. The reason for this is that in between component additions it is necessary to isolate the main system from the manifold in order to prepare the system for the next addition. Also, this allows AccuGrav to confirm that the next component is of sufficient pressure to complete the desired addition and avoid back flow.

Manifold PSI. Pressure(psig) of manifold not the system. Used to determine the actual pressure in the manifold and/or the cylinders. Used to determine if next component to be added has sufficient pressure.

Eg: The next component is at least 100 psig greater than the current manifold pressure.

Mix Tolerance. This a user input as a double precision numeric that determines the tolerance to which the mix should be produced. In addition, this variable is used in other areas of the program which correlate mixture tolerance with rate of change of the Metler balance.

Previous Weight. This number is a double precision floating value which represents the scale reading on the programs last iteration.

Control Valve. This is a double precision numeric control that outputs the mAmp value to the control value.

Purge Gas. Enumerated type that returns the Purge gas used in the system. May be one of the following: CO(2), He, Ar, N(2)

Current Component. Integer scalar variable used to index the following arrays: Desired Weights and Actual Weights.

Component Valve. This is an 8 element boolean array: int1, int2, int3, int4, CO(2), He, Ar, N(2). This is used in the logic loop of the program to control when a given valve is open or closed. The data acquisition loop constantly monitors a local variable of this array to determine when a change has occurred so it may update Fieldpoint to carry out the instruction. In addition, as a result of Fieldpoint issuing a command to the valve, two more arrays, which represent the valve switches are monitored: Normally open component valves and normally closed component valves. These arrays are constantly compared to the component valve array in the main logic loop in an effort to verify that the valve indeed has completed the instructed.

System Valves. This is an 5 element boolean array: Vent, Vacuum, High Flow, Lo Flow, Manifold. This is used in the logic loop of the program to control when a given valve is open or closed. The data acquisition loop constantly monitors a local variable of this array to determine when a change has occurred so it may update Fieldpoint to carry out the instruction. In addition, as a result of Fieldpoint issuing a command to the valve, two more arrays, which represent the valve switches are monitored: Normally open system valves and normally closed system valves. These arrays are constantly compared to the system valve array in the main logic loop in an effort to verify that the valve indeed has completed the instruction.

In Spec? 8 Element boolean array that represents whether or not the desired component is within the tolerance determined by an range and range check algorithm Eg.

Actual component weight = 100

Desired component weight = 99

Mix Tolerance = 1 (percent)

Mix Tolerance Divisor = 2

Tolerance range = ((Mix Tolerance/MixToleranceDivisor)/100)*Desired Weight)

The Tolerance range is added and subtracted to the desired weight to establish and acceptable range. A check calculation is also done to account for cases of tight tolerance ranges and errors such as scale drift do to a non-system anomaly.

(eg. user bumping the scale)

First Time? This is a boolean control that indicates that the system has completed its first full iteration. This is necessary to let certain procedures be executed on the first iteration. Upon reaching the state, "loop or cycle", if there is more than one component this boolean is set to false, which allows AcuGrav to bypass these initialization procedures.

Eg. There is no need to re-run the "system integrity state" on successive components as AcuGrav as already determined that the system is suitable.

High PSI? This boolean is flagged to true when the system pressure exceeds or is equal to the upper pressure limit of 1000 Torr.

Prev PSI. This double precision numeric holds the value of the pressure of the last iteration.

Notifier. notifier is a reference to an existing or newly created notifier.

This notifier is used by the error checking state machine to begin cycling. This allows the program to get stride before being subjected error evaluation.

Cyl Qty. Number of cylinders to be filled with indicated recipe. This is essential in calculating Cubic Feet, which in turn is essential for determining flow rate.

Total CF. This is the total cubic feet determined by cylinder quantity and cylinder volume.

EG.

2(quantity)* 150 = 300 cubic feet (CF)

Vac Low. This double precision floating variable represents the current Lo Vacuum channel reading in mTorr Previous Man. Pressure Used in conjunction with a shift register to compare the difference in manifold pressure from one iteration to the next.

Gross leak start time. This value uses the system clock to establish a starting mark for a 60 second interval used to determine if all applicable system segments are able to achieve a less than 200 mTorr vacuum.

Scale Deltas. Cluster containing a 10 element array to serve as a buffer for the last 10 scale readings. It also contains an integer numeric control for the index of the buffer.

Vacuum Deltas. This cluster contains a circular array and digital control. The circular array is a 10 element array containing a values representing the difference of the actual measurement and the previous measurement taken. In a nut shell, it keeps track of the discrepancy in repetitive measurements.

Equalize Start Time. This value is a piece of code that is no longer current and is not used in the present version. It will probably be eliminated in future versions.

error out. The error out cluster passes error or warning information out of a VI to be used by other VIs.

The pop-up option Explain Error (or Explain Warning) gives more information about the error displayed.

status. The status boolean is either TRUE (X) for an error, or FALSE (checkmark) for no error or a warning.

The pop-up option Explain Error (or Explain Warning) gives more information about the error displayed.

code. The code input identifies the error or warning.

The pop-up option Explain Error (or Explain Warning) gives more information about the error displayed.

source. The source string describes the origin of the error or warning.

The pop-up option Explain Error (or Explain Warning) gives more information about the error displayed.

Running Params OUT

Fill Time. Time it takes to fill the cylinder. Continuously updated as cycle per gases.

Desired Weights. 8 element array for the desired weights relative to the inlet position.

Weights. Element of the Desired Weights Array. There are 8 elements in this array. Each one representing a corresponding intermediate or house gas.

Actual Weights. This is an 8 element array of current scale readings relative to the inlet position.

TABLE 1-continued

| CLUSTERS OF INFORMATION AND DATA USED BY THE PROCESSOR FOR CONTROL AND STATUS INDICATIONS. |
|---|
| Weights. Element of Actual Weights Array. |
| Vac Hi. This double precision floating variable represents the current Hi Vacuum channel reading in Torr |
| System Pressure. Pressure(psig) of system not manifold. Used to take pressure readings that do not require the manifold valve to be open. The reason for this is that in between component additions it is necessary to isolate the main system from the manifold in order to prepare the system for the next addition. Also, this allows AccuGrav to confirm that the next component is of sufficient pressure to complete the desired addition and avoid back flow. |
| Manifold PSI. Pressure(psig) of manifold not the system. Used to determine the actual pressure in the manifold and/or the cylinders. Used to determine if next component to be added has sufficient pressure. |
| Eg: The next component is at least 100 psig greater than the current manifold pressure. |
| Mix Tolerance. This a user input as a double precision numeric that determines the tolerance to which the mix should be produced. In addition, this variable is used in other areas of the program which correlate mixture tolerance with rate of change of the Metler balance. |
| Previous Weight. This number is a double precision floating value which represents the scale reading on the programs last iteration. |
| Control Valve. This is a double precision numeric control that outputs the mAmp value to the control value. |
| Purge Gas. Enumerated type that returns the Purge gas used in the system. May be one of the following: CO(2), He, Ar, N(2) |
| Current Component. Integer scalar variable used to index the following arrays: Desired Weights and Actual Weights. |
| Component Valve. This is an 8 element boolean array: int1, int2, int3, int4, CO(2), He, Ar, N(2). This is used in the logic loop of the program to control when a given valve is open or closed. The data acquisition loop constantly monitors a local variable of this array to determine when a change has occurred so it may update Fieldpoint to carry out the instruction. In addition, as a result of Fieldpoint issuing a command to the valve, two more arrays, which represent the valve switches are monitored: Normally open component valves and normally closed component valves. These arrays are constantly compared to the component valve array in the main logic loop in an effort to verify that the valve indeed has completed the instructed. |
| System Valves. This is an 5 element boolean array: Vent, Vacuum, High Flow, Lo Flow, Manifold. This is used in the logic loop of the program to control when a given valve is open or closed. The data acquisition loop constantly monitors a local variable of this array to determine when a change has occurred so it may update Fieldpoint to carry out the instruction. In addition, as a result of Fieldpoint issuing a command to the valve, two more arrays, which represent the valve switches are monitored: Normally open system valves and normally closed system valves. These arrays are constantly compared to the system valve array in the main logic loop in an effort to verify that the valve indeed has completed the instruction. |
| In Spec? 8 Element boolean array that represents whether or not the desired component is within the tolerance determined by an range and range check algorithm |
| Eg. |
| Actual component weight = 100 |
| Desired component weight = 99 |
| Mix Tolerance = 1 (percent) |
| Mix Tolerance Divisor = 2 |
| Tolerance range = ((Mix Tolerance/MixToleranceDivisor)/ 100)*Desired Weight) |
| The Tolerance range is added and subtracted to the desired weight to establish and acceptable range. A check calculation is also done to account for cases of tight tolerance ranges and errors such as scale drift do to a non-system anomaly. |
| (eg. user bumping the scale) |
| First Time? This is a boolean control that indicates that the system has completed its first full iteration. This is necessary to let certain procedures be executed on the first iteration. Upon reaching the state, "loop or cycle", if there is more than one component this boolean is set to false, which allows AcuGrav to bypass these initialization procedures. |
| Eg. There is no need to re-run the "system integrity state" on successive components as AcuGrav has already determined that the system is suitable. |

TABLE 1-continued

| CLUSTERS OF INFORMATION AND DATA USED BY THE PROCESSOR FOR CONTROL AND STATUS INDICATIONS. |
|---|
| High PSI? This boolean is flagged to true when the system pressure exceeds or is equal to the upper pressure limit of 1000 Torr. |
| Prev PSI. This double precision numeric holds the value of the pressure of the last iteration. |
| Notifier. notifier is a reference to an existing or newly created notifier. |
| This notifier is used by the error checking state machine to begin cycling. This allows the program to get stride before being subjected error evaluation. |
| Cyl Qty. Number of cylinders to be filled with indicated recipe. This is essential in calculating Cubic Feet, which in turn is essential for determining flow rate. |
| Total CF. This is the total cubic feet determined by cylinder quantity and cylinder volume. |
| EG. |
| 2(quantity)* 150 = 300 cubic feet (CF) |
| Vac Low. This double precision floating variable represents the current Lo Vacuum channel reading in mTorr |
| Previous Man. Pressure. Used in conjunction with a shift register to compare the difference in manifold pressure from one iteration to the next. |
| Gross leak start time. This value uses the system clock to establish a starting mark for a 60 second interval used to determine if all applicable system segments are able to achieve a less than 200 mTorr vacuum. |
| Scale Deltas. Cluster containing a 10 element array to serve as a buffer for the last 10 scale readings. It also contains an integer numeric control for the index of the buffer. |
| Vacuum Deltas. This cluster contains a circular array and digital control. The circular array is a 10 element array containing a values representing the difference of the actual measurement and the previous measurement taken. In a nut shell, it keeps track of the discrepancy in repetitive measurements. |

TABLE 2

| CONTROL VALVE ADJUSTMENT LOGIC PERFORMED BY BADGER CONTROL ROUTINE |
|---|
| IF (DESIRED WEIGHT) of the (CURRENT COMP) (−) the (ACTUAL WEIGHT) (×) .01 is >/ to the (ACTUAL WEIGHT) (−) (PREVIOUS WEIGHT) |
| OR |
| The (SCALE DELTAS) is = 0 |
| THEN "State Machine Cycles" |
| ELSE (DESIRED WEIGHT) of the (CURRENT COMP) (−) the (ACTUAL WEIGHT) (×) .01 is </ to the (ACTUAL WEIGHT) (−) (PREVIOUS WEIGHT) |
| OR |
| The (SCALE DELTAS) is > 0 |
| THEN |
| IF (ACTUAL WEIGHT) (−) (PREVIOUS WEIGHT) is < the (DESIRED WEIGHT) (−) (ACTUAL WEIGHT) (×) .01 |
| THEN |
| IF (CONTROL VALVE) value is >/ .02 "Valve is wide open" |
| ELSE Add (mA ADJUSTMENT) to (CONTROL VALVE) |
| IF (ACTUAL WEIGHT) (−) (PREVIOUS WEIGHT) |
| is < the (DESIRED WEIGHT) (−) (ACTUAL WEIGHT) (×) .01 |
| THEN |
| IF (CONTROL VALVE) value is </ .004 "Valve is closed" |
| ELSE Subtract (mA ADJUSTMENT) from (CONTROL VALVE) |

What is claimed:

1. In a computer controlled system for filling a cylinder with a gas, the system including (a) a source of gas, (b) a plurality of valves for controlling flow of the gas to the cylinder, (c) a transducer for measuring pressure of the gas flowing to the cylinder, and (d) a weight scale for determining weight of the cylinder when filling the cylinder with the gas, a method of filling the cylinder with a target weight of the gas comprising the steps of:

(a) successively measuring the weight of the cylinder at periodic time intervals to obtain successive actual weights of the cylinder;

(b) opening a first valve and filling the cylinder with the gas at a high flow rate;

(c) closing the first valve after reaching a predetermined weight difference between the target weight and an actual weight;

(d) after step (c), opening a second valve and filling the cylinder with the gas at a low flow rate;

(e) after step (d), controlling by an adjustable valve, flow of the gas to the cylinder;

(f) differencing each successive actual weight measured in step (a) from the target weight of the gas to obtain a plurality of first difference values;

(g) differencing adjacently measured actual weights obtained in step (a) to obtain a plurality of second difference values; and (h) controlling, by the adjustable valve, flow of the gas to the cylinder based on each first difference value and a corresponding second difference value.

2. The method of claim 1 in which step (h) includes multiplying each first difference value by a constant value to obtain a respective scaled first difference value, comparing a scaled first difference value with a corresponding second difference value, and adjusting flow of the gas to the cylinder based on the comparison.

3. The method of claim 2 in which step (g) includes logging into a buffer the plurality of second difference values; and step (h) includes either of the following sub-step (i) or sub-step (ii):

(i) maintaining flow of the gas to the cylinder, if the plurality of second difference values stored in the buffer are greater than the corresponding first scaled difference values; or (ii) adjusting flow of the gas to the cylinder, if the plurality of second difference values stored in the buffer are less than the corresponding first scaled difference values.

4. The method of claim 3 in which sub-step (ii) includes sending a reduced current value to the adjustable valve to reduce the rate of flow of gas to the cylinder.

5. The method of claim 4 in which the reduced current value is based on a user mix tolerance value, and the reduced current value sent to the adjustable valve is a first current value if the user mix tolerance value is less than or equal to 1 percent, and is a second current value if the user mix tolerance is greater than 1 percent, the first current value being smaller than the second current value.

6. The method of claim 5 in which the first current value is 0.00001 milliamperes, and the second current value is 0.0001 milliamperes.

7. The method of claim 1 including the steps of:

(i) establishing a tolerance range value between the target weight of the gas cylinder and a measured actual weight of the gas cylinder; and (j) rejecting the gas cylinder if the actual weight of the gas cylinder is outside the established tolerance range value;

wherein the tolerance range value is based on a ratio of a user mix tolerance value and a mix tolerance divisor, the mix tolerance divisor being a first value when a pressure of the gas supplied to the cylinder is greater than 1000 psig and a second value when the pressure of the gas supplied to the cylinder is less than 1000 psig, the first value being larger than the second value.

8. In a computer controlled system for filling cylinders with at least one gas, including multiple valves for controlling flow of respective gasses to the cylinders, a method of controlling filling of the cylinders comprising the steps of:

(a) storing valve command data in a first array;

(b) communicating the stored valve command data to the valves;

(c) monitoring status of each of the multiple valves;

(d) waiting a predetermined time after communicating the stored valve command data to the valves in step (b);

(e) storing the status of the valves in a second array, after waiting the predetermined time in step (d);

(f) comparing the valve command data stored in the first array with the valve status stored in the second array; and (g) continuing filling of the cylinders with the gas based on the comparison in step (f).

9. The method of claim 8 in which step (f) includes determining if the valve status stored in the second array corresponds to the valve command data stored in the first array; and step (g) includes stopping the filling of the cylinders, if the comparison determines that the valve status is different from the valve command data.

10. The method of claim 8 further including the step of:

(h) displaying the valve status on a screen.

11. The method of claim 8 further including the steps of:

(h) displaying the multiple valves on a screen; and (i) programming virtual instruments to control the multiple valves and displaying the virtual instruments on the screen; and in which step (b) includes communicating the stored valve command data to the multiple valves using the virtual instruments.

12. The method of claim 11 in which programming the virtual instruments includes configuring the virtual instruments on the screen using G programming language.

13. In a computer controlled system for filling a cylinder with a gas, the system including (a) a source of gas, (b) at least one valve for controlling flow of the gas to the cylinder, (c) a transducer for measuring pressure of the gas flowing to the cylinder, and (d) a weight scale for determining weight of the cylinder when filling the cylinder with the gas, a method of filling the cylinder to a target weight of gas comprising the steps of:

(a) successively measuring the weight of the cylinder to obtain successive actual weights of the cylinder;

(b) opening a first valve and filling the cylinder with the gas at a high flow rate;

(c) closing the first valve after reaching a predetermined weight difference between the target weight and an actual weight;

(d) after step (c), opening a second valve and filling the cylinder with the gas at a low flow rate; and (e) after step (d), controlling by a third valve, a flow of gas to the cylinder;

wherein controlling by the third valve includes reducing the flow of gas to the cylinder, if a difference value between successive actual weights of the cylinder is smaller than a predetermined value.

14. The method of claim 13 in which step (c) includes closing the first valve after reaching a weight difference of 30 grams or less between the target weight and the actual weight.

15. The method of claim 14 including the step of:

(f) measuring pressure of the gas flowing to the cylinder; and step (c) includes closing the first valve after measuring 1000 psi of pressure.

16. The method of claim 13 in which reducing the flow of gas to the cylinder includes adjusting an amount of gas flowing through the third valve by a first value, if a user mix tolerance value is less than or equal to one percent, and adjusting the amount of gas flowing through the third valve by a second value, if the user mix tolerance value is greater than one percent.

17. The method of claim 16 in which control current is sent to the third valve to control the amount of gas flowing to the cylinder; and the first value for adjusting the amount of gas flowing through the third valve is 0.00001 milliamperes, and the second value is 0.001 milliamperes.

18. The method of claim 16 in which reducing the flow of gas to the cylinder includes periodically adjusting the third valve until a difference between the target weight and the actual weight is less than or equal to 0.1 grams.

19. The method of claim 13 wherein the first valve is closed after reaching a 30 gram weight difference between the target weight and the actual weight, and the second valve is opened to fill the cylinder at the low flow rate.

20. The method of claim 13 wherein step (a) includes successively measuring the actual weight of the cylinder at a periodic rate of 10 sample measurements per second.

* * * * *